US005921836A

United States Patent [19]

Nanto et al.

[11] Patent Number: 5,921,836

[45] Date of Patent: Jul. 13, 1999

[54] APPARATUS FOR FORMING FLUORESCENT LAYERS OF A PLASMA DISPLAY PANEL AND METHOD THEREFOR

[75] Inventors: Toshiyuki Nanto; Teruo Kurai; Masayuki Wakitani, all of Kawasaki; Ryouichi Miura; Yasuo Yanagibashi, both of Satsuma-gun, all of Japan

[73] Assignee: Fujitsu Limited, Kawasaki, Japan

[21] Appl. No.: 08/789,667

[22] Filed: Jan. 27, 1997

[30] Foreign Application Priority Data

May 9, 1996 [JP] Japan ..... 8-114884
Dec. 17, 1996 [JP] Japan ..... 8-337189

[51] Int. Cl.[6] ..... H01J 1/30

[52] U.S. Cl. ..... 445/24; 445/58; 445/60

[58] Field of Search ..... 445/24, 52, 58, 445/60

[56] References Cited

U.S. PATENT DOCUMENTS 2,916,012 12/1959 Hergenrother et al. .
4,267,204 5/1981 Tomita et al. .
5,601,468 2/1997 Fujii et al. ..... 445/24
5,643,034 7/1997 Mohri et al. ..... 445/24

FOREIGN PATENT DOCUMENTS 55-32314 3/1980 Japan .
57-21223 5/1982 Japan .
57-084545 8/1982 Japan .
61-245106 10/1986 Japan .
63-155527 11/1988 Japan .
5-299019 11/1993 Japan .
7-021913 1/1995 Japan .

*Primary Examiner*—Kenneth J. Ramsey
*Attorney, Agent, or Firm*—Staas & Halsey

[57] ABSTRACT

There is disclosed an apparatus for forming a fluorescent layer in a plasma display panel by applying a fluorescent paste into grooves formed between a plurality of ribs disposed in parallel on a surface of a substrate. The apparatus includes: a platform for mounting the substrate thereon; a dispenser having at least one nozzle for ejecting the fluorescent paste; a transporter for moving the nozzle relative to the platform; and a controller for controlling the transporter and the dispenser so that the fluorescent paste is consecutively applied into the predetermined grooves between the ribs.

26 Claims, 17 Drawing Sheets

APPARATUS FOR FORMING FLUORESCENT LAYERS OF A PLASMA DISPLAY PANEL AND METHOD THEREFOR

BACKGROUND OF THE INVENTION

1. Field of the Invention

The present invention relates to an apparatus for forming fluorescent layers of a plasma display panel and a method therefor. More particularly, the present invention relates to an apparatus which is used in manufacturing a plasma display panel (PDP) and which forms, on a substrate having a plurality of ribs (partition walls) on the surface thereof, a fluorescent layer in each of the spaces formed between the ribs and a method therefor.

2. Description of the Related Arts

A PDP is a display panel having, as a base, a pair of substrates (typically, glass plates) disposed opposite to each other with a discharge space sandwiched therebetween. In a PDP, by disposing a fluorescent layer of an ultraviolet-ray excitation type in the discharge space, it is possible to display a color since the fluorescent layer is excited by electric discharge. PDPs for displaying colors have three fluorescent layers of R (red), G (Green), and B (Blue).

Conventionally, fluorescent layers of R, G, and B were manufactured by successively applying, on a substrate, fluorescent pastes for the three colors containing powder-like fluorescent particles as a major component by screen printing method, followed by drying and sintering (for example, see Japanese Unexamined (Kokai) Patent Publication No. Hei 5(1993)-299019).

However, as the screen size of PDPs increase, an alignment shift is brought about between a positioning pattern and a mask pattern of the ribs due to the expansion and contraction of the screen mask, an error in positioning, and the like, so that it is becoming more and more difficult to achieve precise application of the fluorescent pastes between the ribs.

SUMMARY OF THE INVENTION

The present invention has been made in view of the above circumstances and the purpose thereof is to provide an apparatus for forming fluorescent layers uniformly and precisely between the ribs on the substrate for constructing a large PDP, and a method therefor.

The present invention provides an apparatus for forming a fluorescent layer in a plasma display panel by applying a fluorescent paste into grooves formed between a plurality of ribs disposed in parallel on a surface of a substrate, the apparatus comprising: a platform for mounting the substrate thereon; a dispenser having at least one nozzle for ejecting the fluorescent paste; a transporter for moving the nozzle relative to the platform; and a controller for controlling the transporter and the dispenser so that the fluorescent paste is consecutively applied into the predetermined grooves between the ribs.

The present invention also provides a method for consecutively applying a plurality of fluorescent pastes having different colors into grooves formed between a plurality of ribs disposed in parallel on a substrate surface, the different colors including at least first and second colors, the method comprising the steps of: preparing a plurality of fluorescent layer forming apparatus each ejecting a fluorescent paste of each color; applying the fluorescent paste of the first color into first grooves on the substrate surface with one of the fluorescent layer forming apparatus, the first grooves corresponding to the fluorescent paste of the first color; drying the fluorescent paste of the first color applied into the first grooves to such a degree that at least no surface tension is generated; applying the fluorescent paste of the second color subsequently with another of the fluorescent layer forming apparatus into second grooves adjacent the first grooves on the substrate, the second grooves corresponding to the fluorescent paste of the second color; and drying the fluorescent paste of the second color applied into the second grooves to such a degree that at least no surface tension is generated, and alternately repeating the steps of applying and drying the fluorescent paste of each color.

DETAILED DESCRIPTION OF THE PREFERRED EMBODIMENTS

Figure 1:
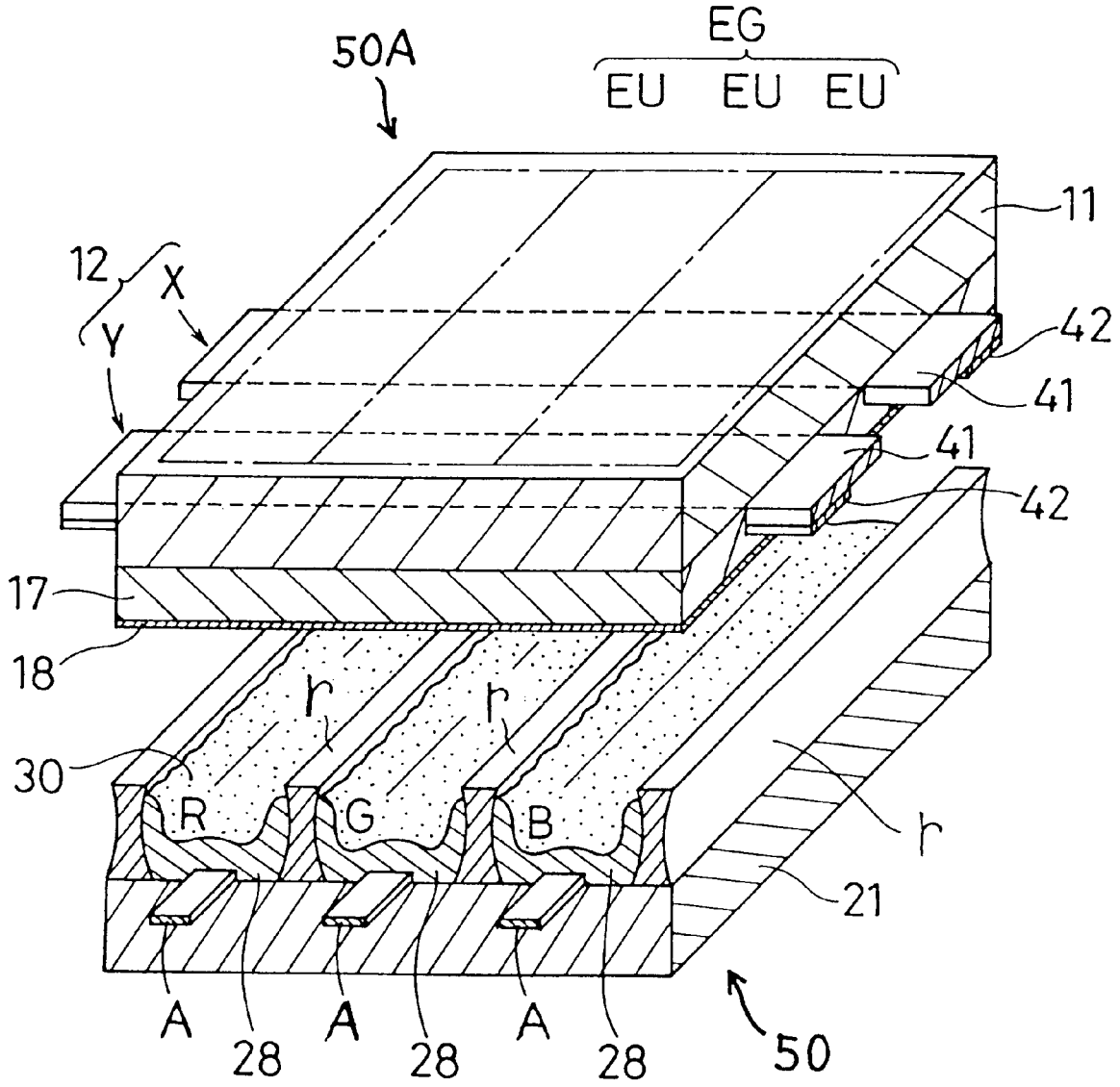
FIG. 1 is a perspective view showing the essential part of a plasma display panel according to the present invention.

The plasma display panel (PDP) according to the present invention is constructed in such a manner that an electric discharge is locally generated between a pair of opposing substrates so that the partitioned fluorescent layers on the substrate are excited to emit light. The PDP is constituted, for example, by a pair of substrate assemblies 50, 50*a* shown in FIG. 1 (for one pixel).

In the substrate assembly 50*a*, a pair of sustaining electrodes X, Y are arranged per each line on the inside surface of a front-side glass substrate 11 for generating a surface discharge along the substrate surface. Each of the sustaining electrodes X, Y includes a wide linear band-like transparent electrode 41 made of a thin ITO film and a narrow linear band-like bus electrode 42 made of a thin metal film.

The bus electrode 42 is an auxiliary electrode for securing a proper electric conductivity. A dielectric layer 17 is provided so as to cover the sustaining electrodes X, Y. A protective film 18 is deposited by vaporization on the surface of the dielectric layer 17. Both the dielectric layer 17 and the protective film 18 have a light transmission property.

In the substrate assembly 50, address electrodes A are arranged on the inside surface of the rear-side glass substrate 21 so that the address electrodes A are perpendicular to the sustaining electrodes X, Y. A linear rib r is disposed in each interval formed between two adjacent address electrodes A. In other words, ribs r and address electrodes A are alternately disposed.

In the substrate assembly 50 (hereafter referred to as "substrate"), these ribs r serve to partition the electric discharge space 30 in the line direction per each subpixel (light emitting region unit) EU and define the gap dimension of the discharge space 30.

Fluorescent layers 28 for displaying three colors R, G, and B are disposed so as to cover the rear-side walls including the upper portion of the address electrodes A and the side surface of the ribs r.

Figure 8:
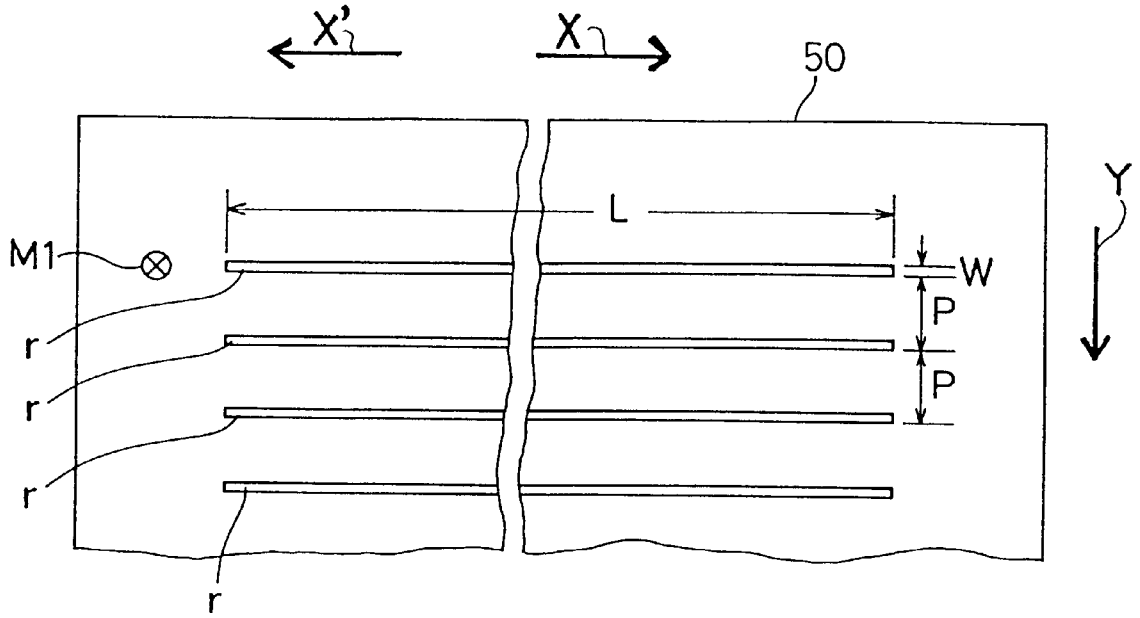
FIG. 8 is an enlarged view showing the essential part of FIG. 7.
Figure 9:
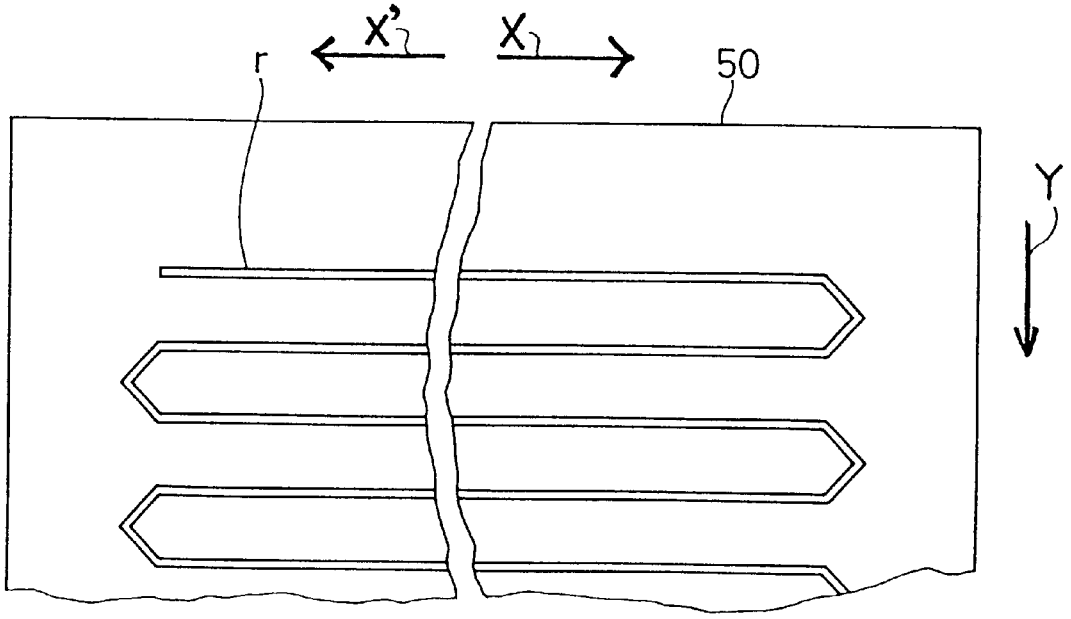
FIG. 9 is an enlarged view showing the essential part of a modified substrate applied to the present invention.
Figure 18:
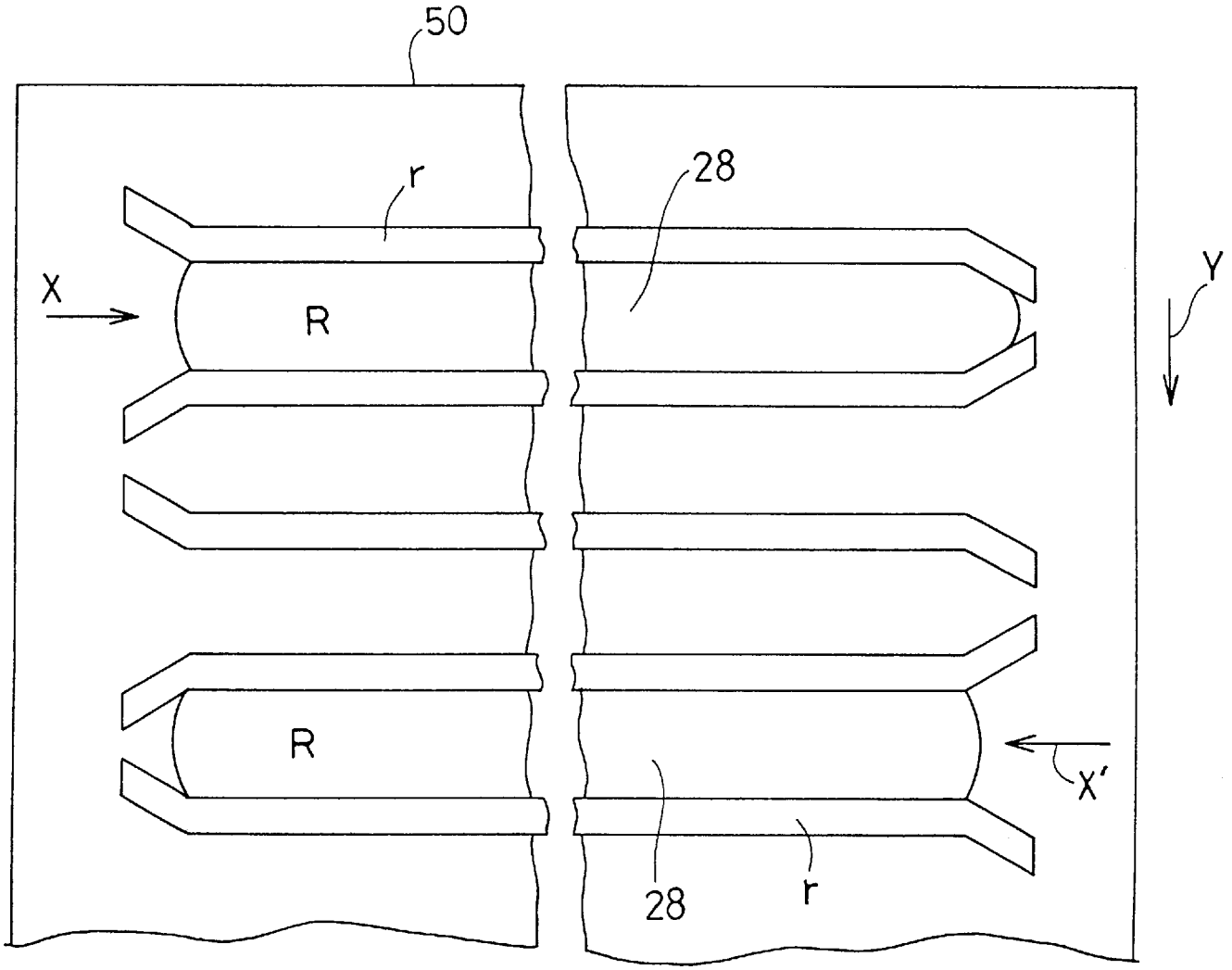
FIG. 18 is a top view showing modified ribs on the substrate to which the present invention is applied.

The ribs r are made of a low melting point glass and are opaque against ultraviolet rays. The ribs r may be formed through a process of providing an etching mask by photolithography on a solid-film low melting point glass layer to carry out patterning with a sandblast. The arrangement of the plurality of ribs to be formed in this process are determined by the pattern of the etching mask. Top views of the substrates showing preferable arrangements of the ribs are given in FIGS. 8, 9, and 18. FIG. 8 shows a parallel arrangement in which the ribs are arranged in parallel with each other. FIG. 9 shows a meandering arrangement in which the ribs meander. FIG. 18 shows an arrangement in which a plurality of ribs r having a straight central portion and opposite ends bent in opposite directions are arranged on the substrate so that two adjacent ribs r leave each other at one end of the groove therebetween and approach each other at the other end of the groove and are parallel to each other at the central portion thereof.

Each pair of sustaining electrodes 12 corresponds to each line in a matrix display. Each address electrode A corresponds to each row. Three rows correspond to one pixel (picture element) EG. In other words, one pixel EG includes three subpixels EU arranged in the line direction, each subpixel representing one of the three colors R, G, and B.

An electric discharge generated between the address electrode A and the sustaining electrode Y controls the state of accumulated wall charge in the dielectric layer 17. Application of sustaining pulses alternately onto sustaining electrodes X, Y induces generation of surface discharge (main discharge) in a subpixel EU where a certain amount of wall charge is present.

Being excited locally by the ultraviolet rays generated through the surface discharge, the fluorescent layers 28 emit visible light of respective colors. This visible light, transmitted through the glass substrate 11, forms the displaying light. Since the arrangement pattern of the ribs 29 is what is known as a stripe pattern, the portion of the discharge space 30 corresponding to each row is continuous along the row and extends over all the lines. The emitted color of a subpixel EU in each row is the same.

In manufacturing such a PDP, the fluorescent layers are formed in a fluorescent layer forming apparatus after the address electrodes A and the ribs 29 are formed on the substrate, as shown in FIG. 1. The platform for mounting the substrate in a fluorescent layer forming apparatus according to the present invention is not specifically limited and may be any platform onto which a substrate can be approximately horizontally and detachably fixed.

The paste-like fluorescent substance (fluorescent paste) for forming the fluorescent layers is, for example, a mixture of a fluorescent substance for each color at 10 to 50 wt%, ethyl cellulose at 5 wt%, and BCA at 45 to 85 wt%.

Here, the fluorescent substance for red may be, for example, (Y, Gd) $B0_3$: Eu. The fluorescent substance for green may be, for example, $Zn_2SiO_4$: Mn or $BaAl_{12}O_{19}$: Mn. The fluorescent substance for blue may be, for example, 3 (Ba, Mg) $O{\cdot}Al_2O_3$: Eu.

Referring to the nozzle of the dispenser for ejecting the fluorescent paste, the inner diameter of the nozzle is set so as to be smaller than the interval between adjacent ribs. However, since the tip of the nozzle is not inserted between the ribs, the outer diameter of the nozzle may be larger than the interval between adjacent ribs. For example, if the interval between the ribs is 170 $\mu$m, the nozzle may preferably have an inner diameter of about 100 $\mu$m and an outer diameter of about 300 $\mu$m. As the nozzle, a multi-nozzle may be used in which a plurality (for example, 5 to 30) of nozzles are arranged with a predetermined coating pitch along the direction perpendicular to the ribs. In such a case, a plurality of grooves are coated simultaneously, providing an efficient coating step.

The fluorescent paste supplier, namely, the dispenser for supplying fluorescent pastes into the grooves may include a nozzle, a vessel (syringe) connected to the rear end of the nozzle and containing the paste-like fluorescent substance, and a pressure generator for pressing the fluorescent substance in the vessel out into the nozzle. As the supplier, a commercially available dispenser system (for example, System C Type manufactured by Musashi Engineering Co., Ltd. in Japan) may be used.

The transporter to be used in accordance with the present invention may be one in which the nozzle and the platform are moved relative to each other so that the tip of the nozzle can be moved in three directions, namely, in the direction parallel to the ribs, in the direction perpendicular to the ribs on the substrate, and in the direction perpendicular to the substrate. Typical examples of the transporter are a three-axis robot and a three-axis manipulator.

A motor, an air cylinder, a hydraulic cylinder, or the like may be used as the driving force source for driving each of the axes according to the present invention. However, in view of the facility and accuracy of control, it is preferable to use a stepping motor or a servomotor equipped with an encoder.

The controller for controlling the moving operation of the transporter and the ejecting operation of the nozzle may consist of a microcomputer and a driver circuit. The microcomputer may include a CPU, a ROM, and an I/O port. The driver circuit drives the driving force source of the nozzle transporter. A key board, a tablet, a mouse, or the like may be used as the input section for setting the controlling condition of the controller.

In the fluorescent layer forming apparatus constructed as shown above, a substrate with a plurality of parallel linear ribs formed on a surface thereof at a predetermined pitch is mounted on a platform. Subsequently, fluorescent layers are formed in each of the grooves between adjacent ribs by letting the fluorescent paste to eject from the tip of the nozzle while the tip of the nozzle is moved relative to the substrate.

If fluorescent pastes having different colors are to be applied into two adjacent grooves, there is a fear that the two fluorescent pastes are brought into contact and mix with each other by surface tension if a groove is coated with a fluorescent paste immediately after the adjacent groove is coated with another fluorescent paste. Therefore, it is preferable that, after a first groove is coated with a fluorescent paste of a first color and sufficiently dried, an adjacent second groove is coated with a fluorescent paste of a second color.

The conditions regarding the position and the dimension of the ribs such as the rib shape (linear or meandering shape), the rib length, the rib height, the pitch of arranged ribs, the number of arranged ribs, and the positions (coordinates) of the starting point and the end point of coating on the substrate, and the conditions regarding the nozzle such as the moving speed of the nozzle, the distance between the tip of the nozzle and the substrate (or the top of the rib), and the amount of ejected fluorescent paste per hour are set depending on the needs based on the input from the input section. This allows the controller to move the nozzle relative to the substrate in accordance with the rib position and the rib dimension that are thus set.

It is preferable that the fluorescent layer forming apparatus further includes an optical sensor for detecting alignment marks provided on the surface of the substrate. This is because detection of the alignment marks further facilitates recognition and correction of the nozzle position relative to the substrate position or rib position. An example of the optical sensor used in the present invention is a CCD camera.

If an optical sensor is used, alignment marks are formed in advance on the substrate surface corresponding to the position where the ribs are to be formed. In view of efficiency and accuracy, this step of forming the alignment marks is preferably performed simultaneously with the formation of the ribs.

In other words, if the ribs are formed by a printing method, the alignment marks are also simultaneously formed by the printing method. If the ribs are formed by a sandblast method, the alignment marks are also simultaneously formed by the sandblast method.

The controller detects the alignment marks that are thus formed and reads the coordinates thereof in advance by the optical sensor. In the coating process, the controller can thus judge the position and the pitch of each rib to move the nozzle or to modify the previously set position of the rib based on the alignment marks.

Here, the alignment mark may be provided either per each rib or per each prescribed number of ribs. The alignment marks provided at the starting position and at the finishing position of the coating makes it possible to accurately control the movement of the nozzle. The optical sensor may detect the front tip of the rib instead of the alignment mark. If the front tip of the rib is to be detected, it is preferable that dark ribs are formed by mixing a colorant such as a black pigment into the rib material so as to provide a greater difference in brightness between the ribs and the grooves.

Figure 12:
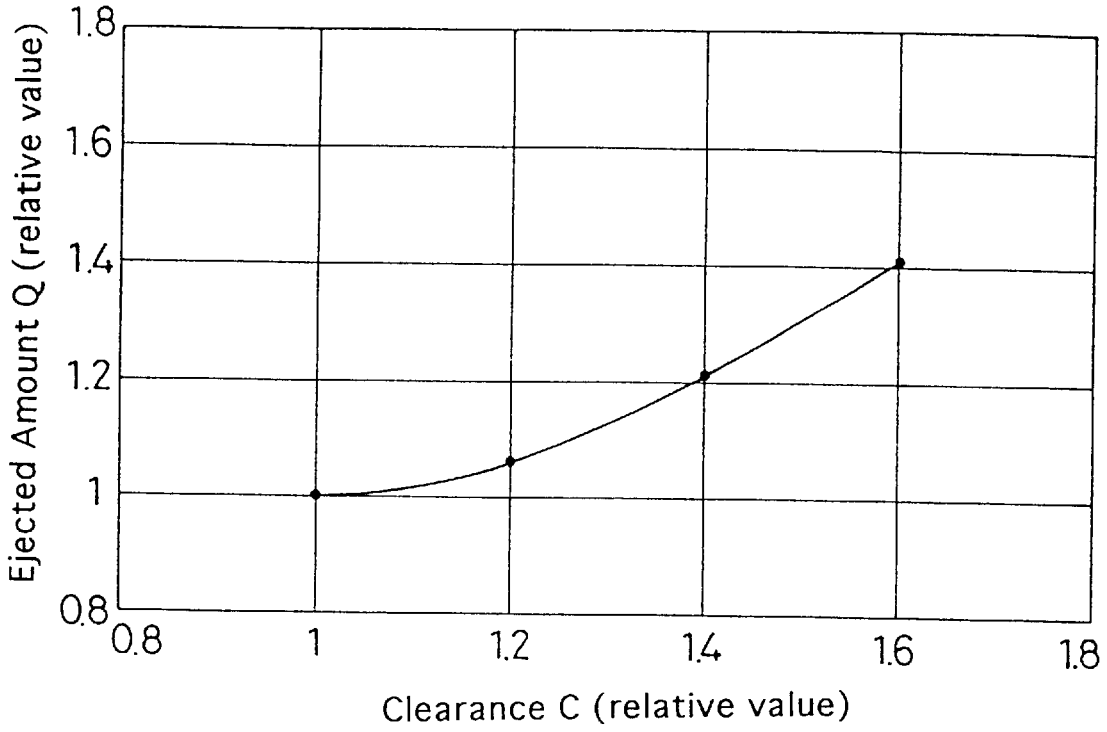
FIG. 12 is a graph showing the relationship between the clearance and the ejected amount of the fluorescent paste according to the present invention.

Referring to FIG. 12, the amount Q ejected from the nozzle tends to increase as the distance C (hereafter referred to as "clearance") between the front tip of the nozzle and the substrate (or the top of the rib) increases. Accordingly, it is preferable to keep the clearance constant in the coating step.

Here, the clearance C is determined to be the most optimal value depending on the viscosity of the fluorescent paste and on the amount of the contained fluorescent substance. The clearance C is usually 100 to 200 $\mu$m. Conversely, by utilizing the above property, the amount Q ejected from the nozzle may be controlled by the clearance C.

Further, if the fluorescent paste is to be ejected between the ribs from the tip of the nozzle for coating, it has been confirmed that, once the coating is started, the fluorescent paste is pulled back to its normal position by its surface tension even when the tip of the nozzle is shifted a little bit from the normal coating position.

Utilizing this property, it is possible to carry out the coating operations smoothly by starting the coating with small clearance (that is, with a small amount of ejection) and restoring the clearance to the previously set distance after a predetermined time has passed so as to restore the ejected amount to the previously set value.

Accordingly, the coating step preferably includes a starting coating step for applying a fluorescent paste while maintaining the distance between the tip of the nozzle and the substrate to be a first distance, and a subsequent stationary coating step for applying the fluorescent paste while maintaining the distance between the tip of the nozzle and the substrate to be a second distance which is larger than the first distance.

Alternatively, an effective display region may be provided at a portion (a central portion) of the substrate surface and an ineffective display region may be provided at a portion (a periphery) of the substrate surface adjacent the effective region, whereby the starting coating step is carried out in the ineffective display region and the stationary coating step is carried out in the effective region.

Since the clearance C varies in accordance with the warping of the substrate or the variation in rib height, the clearance C must be corrected for each substrate. Correction of the clearance C can be performed by measuring the height of the substrate (or the rib) at (three or more) arbitrary points on the substrate to calculate a virtual curved surface (a spline curved surface) connecting the points, over which surface the tip of the nozzle is to be moved with a predetermined clearance C.

Accordingly, if the coating apparatus further comprises a height sensor for measuring the height of an arbitrary point on the substrate surface from the platform, the method for forming fluorescent layers preferably comprises a step of measuring the height of three arbitrary points on the substrate surface and a step of establishing a virtual curved surface connecting the measured points, whereby the tip of the nozzle is moved parallel to the virtual curved surface in the coating step.

Here, the height sensor may be a known optical sensor for determining the distance to an object by emitting a light from a laser diode to the object after high frequency modulation and comparing the phase of the reflected modulated wave with that of a standard wave.

Figure 2:
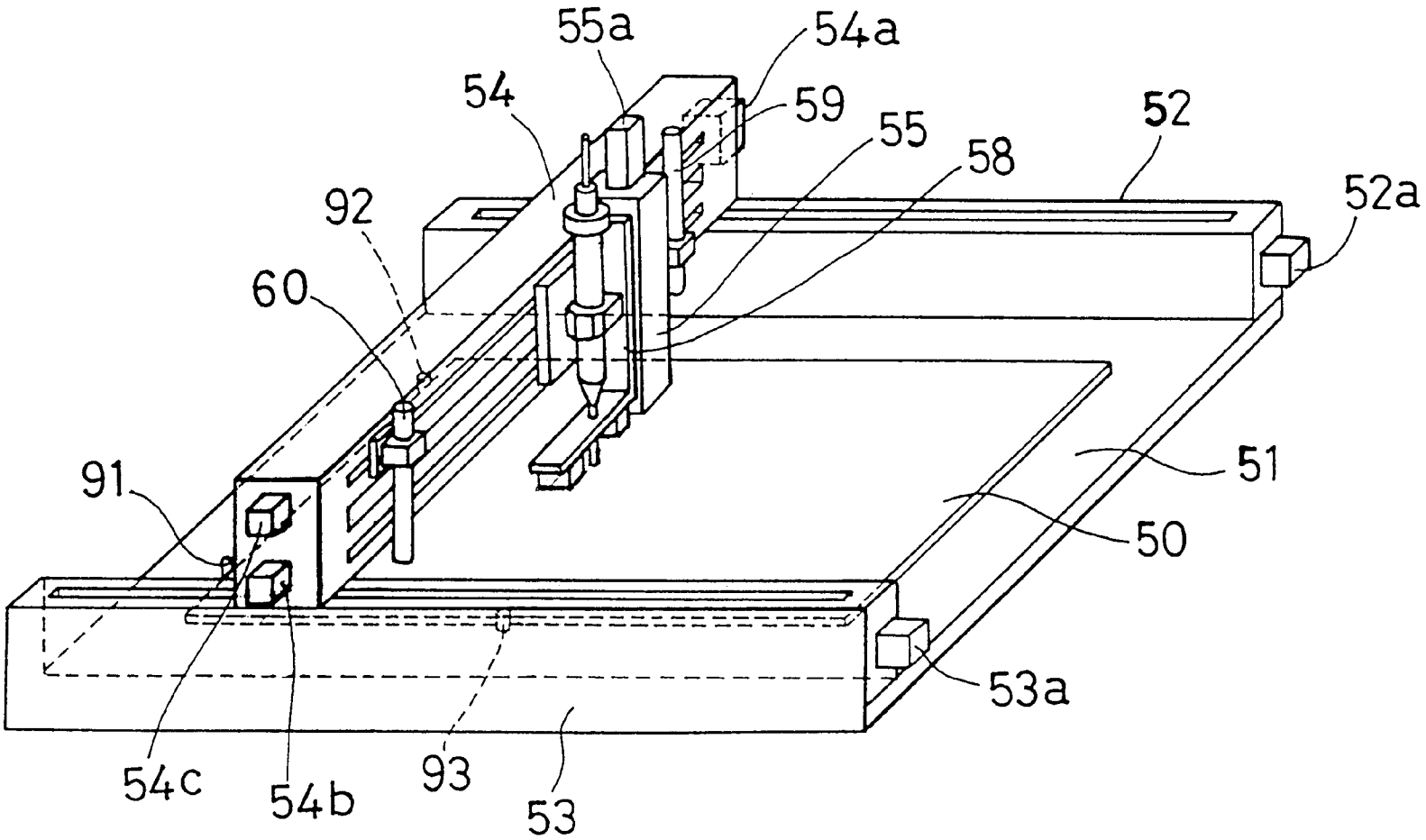
FIG. 2 is a perspective view showing an apparatus according to an embodiment of the present invention.
Figure 3:
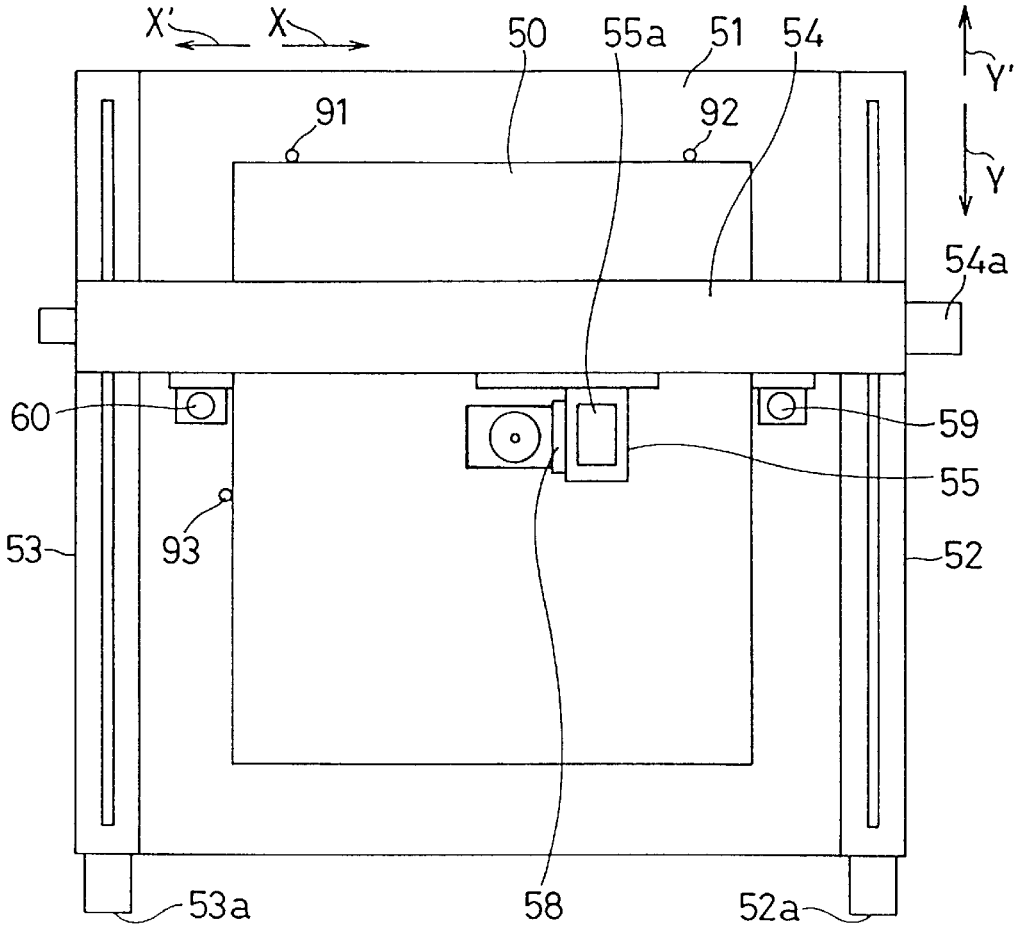
FIG. 3 is a plan view showing the apparatus according to the embodiment of the present invention.
Figure 4:
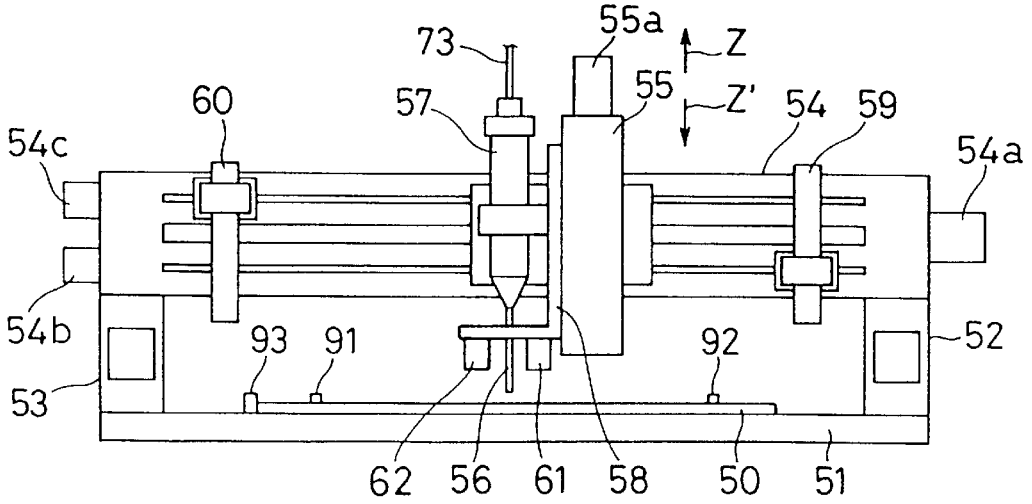
FIG. 4 is a front view showing the apparatus according to the embodiment of the present invention.
Figure 5:
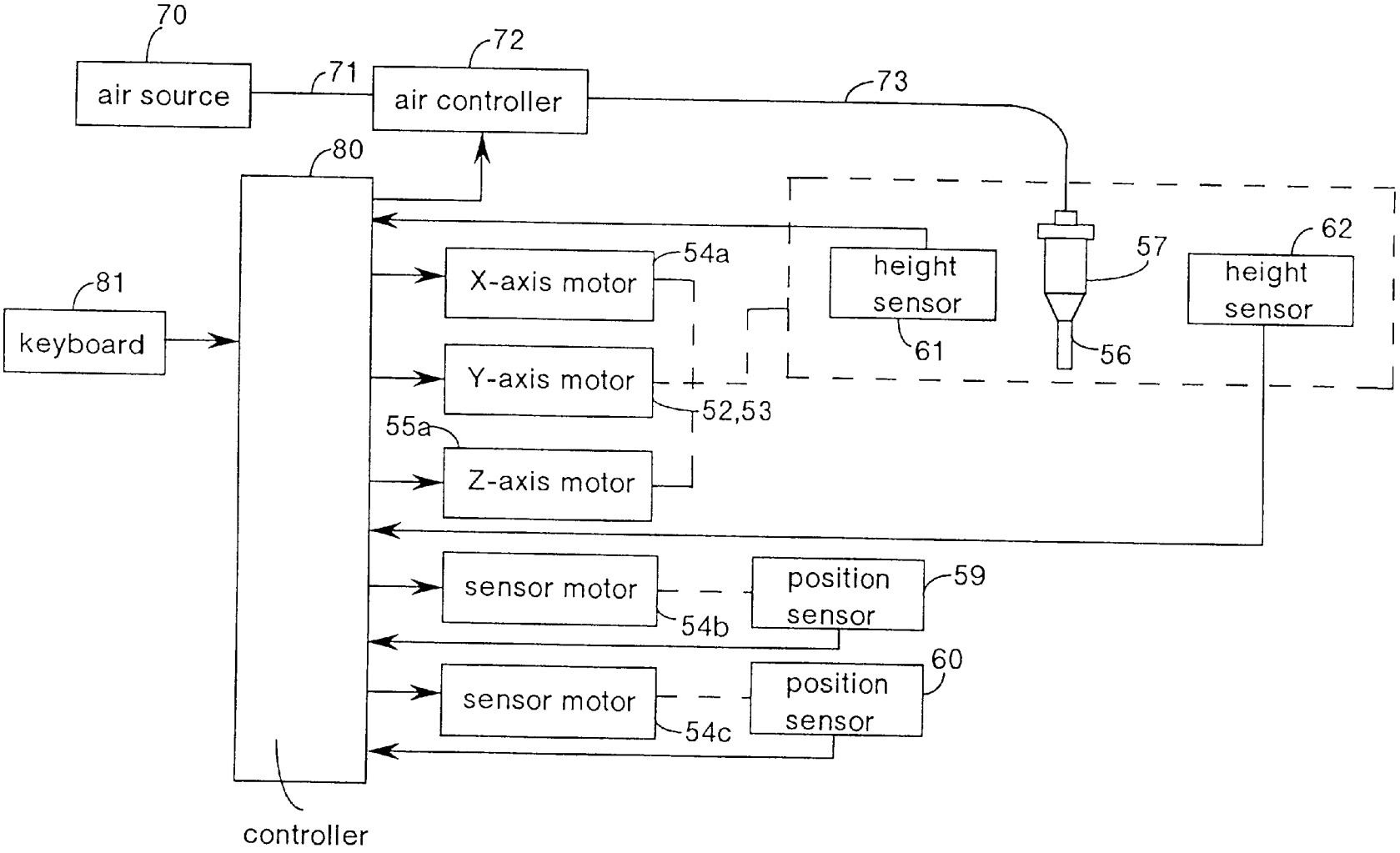
FIG. 5 is a block diagram showing a controller according to the embodiment of the present invention.

FIGS. 2, 3, and 4 are a perspective view, a plan view, and a front view, respectively, of an apparatus for forming fluorescent layers for a 42-inch color PDP. FIG. 5 is a block diagram of a controlling circuit of the apparatus.

Referring to these figures, pins 91 to 93 for positioning the substrate 50 are disposed to stand upright on the platform 51 for mounting the substrate 50, and a sucking apparatus (not shown) is provided for fixing the substrate 50 onto the platform 51 by sucking.

A pair of Y-axis oriented transporters (hereafter referred to as "Y-axis robots") 52, 53 are disposed on both sides of the platform 51. An X-axis oriented transporter (hereafter referred to as "X-axis robot") 54 is mounted onto the Y-axis robots 52, 53 so that the X-axis robot is movable in a direction shown by arrows Y–Y'. A Z-axis oriented transporter (hereafter referred to as "Z-axis robot") 55 is mounted onto the X-axis robot 54 so that the Z-axis robot is movable in a direction shown by arrows X–X'. On the Z-axis robot 55 is mounted a syringe attachment 58 for detachably attaching a dispenser including a nozzle 56 for ejecting a fluorescent paste and a syringe 57, so that the syringe attachment 58 is movable in a direction shown by arrows Z–Z'. Position sensors 59, 60 for detecting the alignment marks on the surface of the substrate 50 are each independently mounted on the X-axis robot 54, so that the sensors 59, 60 are movable in a direction shown by the arrows X–X'. Height sensors 61, 62 are provided for measuring the distance C (the clearance) from the tip of the nozzle 56 to the top of the rib and for measuring the distance from the tip of the nozzle 56 to the surface of the fluorescent paste after the fluorescent paste is applied. The height sensors 61, 62 are fixed onto the foot of the syringe attachment 58 so that the nozzle 56 is positioned between the height sensors 61, 62.

The X-axis robot 54 is transported by Y-axis motors 52*a*, 53*a* in the Y-axis robots 52, 53. The Z-axis robot 55 is transported by an X-axis motor 54*a* in the X-axis robot 54. The position sensors 59, 60 are transported by sensor motors 54*b*, 54*c*, respectively. The syringe attachment 58 is transported by a Z-axis motor 55*a* in the Z-axis robot 55.

Referring to FIG. 5, the controller 80 includes a microcomputer having a CPU, a ROM, and a RAM and controls and drives the X-axis motor 54*a*, the Y-axis motors 52*a*, 53*a*, the Z-axis motor 55*a*, the sensor motors 54*b*, 54*c*, and an air controller 72 on receiving the output from the keyboard 81, the position sensors 59, 60 and the height sensors 61, 62. The controller 80 also lets the CRT 82 to display, in characters and images, the various conditions inputted from the keyboard 81 and the progress of the operation of applying the fluorescent paste.

Air pressure from an air source 70 (for example, an air bomb) is applied to the air controller 72 via an air tube 71. On receiving the output from the controller 80, the air controller 72 applies the air pressure to the syringe 57 via the air tube 73 to keep the amount ejected from the nozzle 56 to be constant.

Figure 6:
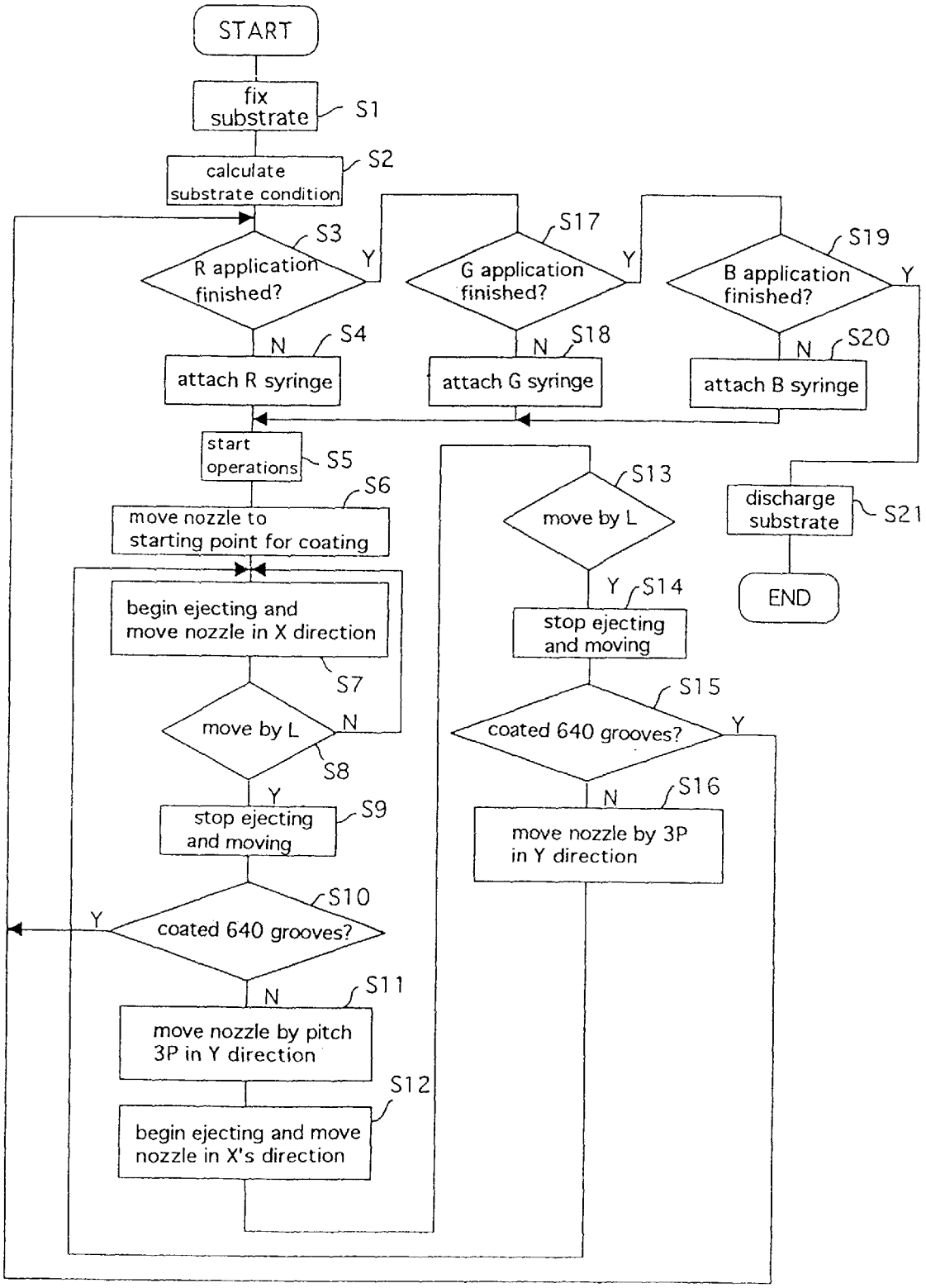
FIG. 6 is a flow chart showing operations according to the embodiment of the present invention.

The procedure for forming fluorescent layers on a substrate for a 42-inch PDP using the apparatus of the present invention will be hereinafter explained in conjunction with the flow chart shown in FIG. 6.

First, the syringe 57 containing 20 cc of a fluorescent paste for forming red (R) fluorescent layers is attached together with the nozzle 56 to the syringe attachment 58.

Figure 7:
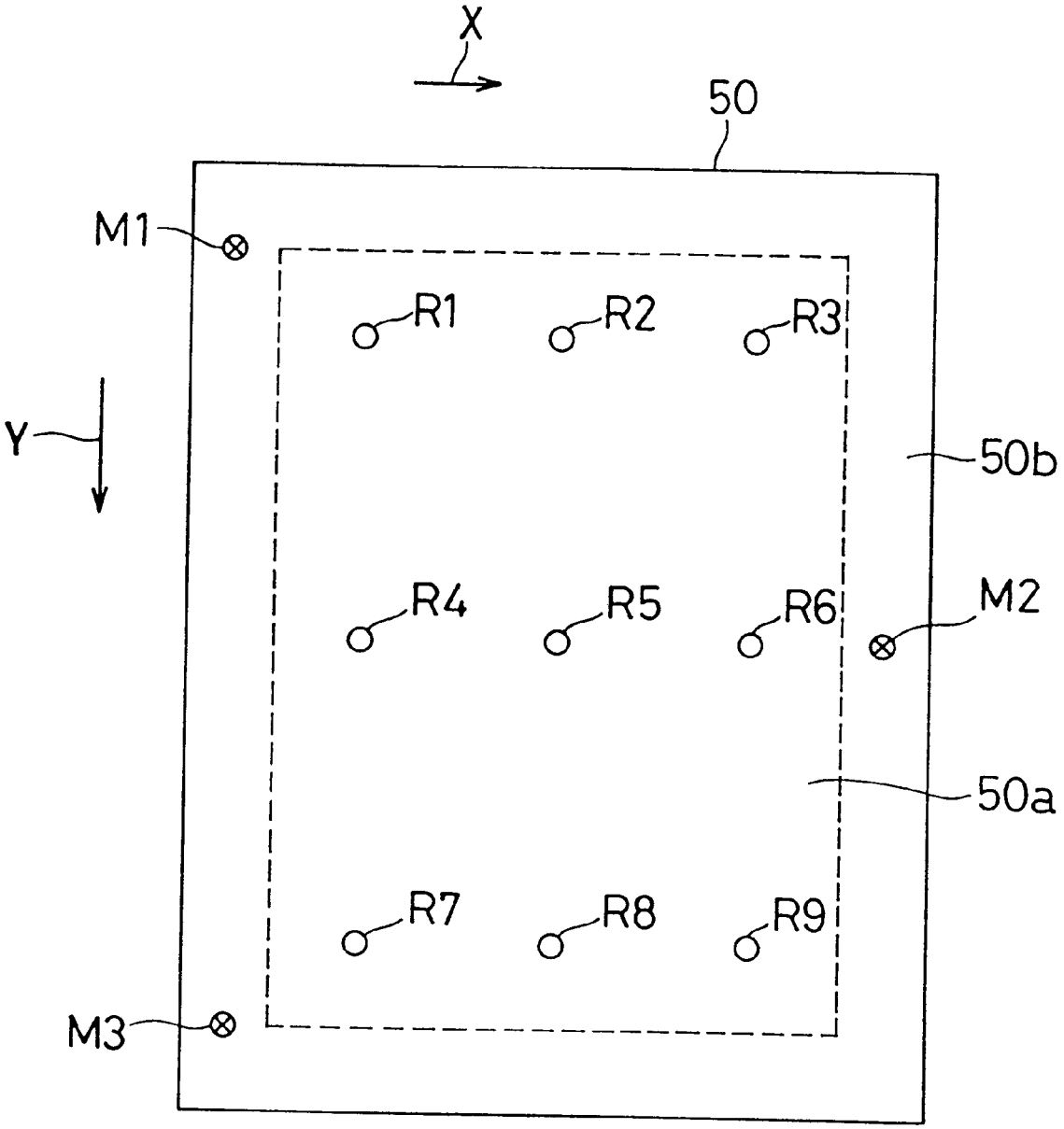
FIG. 7 is a top view showing a substrate according to the embodiment of the present invention.

Referring to FIG. 7, the substrate 50 having an ineffective display (dummy) region 50*b* around the effective display region 50*a* is mounted and fixed at a predetermined position on the platform 51 (step S1).

The substrate 50 consists of a glass plate having a thickness of about 3.0 mm. On the effective display region 50*a* of the substrate 50 are formed, in advance, 1921 ribs r having a length of L=560 mm, a height of H=100 $\mu$m, and a width of W=50 $\mu$m and being parallel to the direction shown by the arrows X–X' with a pitch P, as shown in FIG. 8. On the dummy region 50*b* are formed, in advance, an alignment mark M1 indicating the beginning position of the coating, an alignment mark M2 indicating the center of the substrate, and an alignment mark M3 indicating the end position of the coating, as shown in FIG. 7. Since 1920 grooves are formed on the substrate 50 by 1921 ribs r, the fluorescent materials R, G, and B are each applied on 640 (1920/3) grooves, respectively.

At the time of fixing the substrate, the set values such as the rib height H, the rib width W, the number N of the ribs, the clearance C, the amount Q ejected from the nozzle, the thickness of the fluorescent paste to be applied, the velocity V of nozzle movement, and the coordinates of the height detection regions R1 to R9 (See FIG. 7) are inputted from the keyboard 81.

When the keyboard 81 is operated, the controller 80 detects the condition of the substrate and performs calculation operations (step S2). Specifically, by driving the X-axis robot 54 and the Y-axis robots 52, 53, the controller 80 reads the position of the alignment mark M2 via the position sensor 59, and reads the positions of the alignment marks M1, M3 via the position sensor 60.

The controller 80 then detects, via the height sensor 61, the points P1 to P9 having the maximum substrate height (the height from the platform 51) in the set regions R1 to R9, respectively. Further, the controller 80 calculates coordinates of the starting point for coating, the coating pitch P, the spline curved surface passing through the points P1 to P9, and the like. Here, the pitch P is calculated from the distance between the marks M1 and M2 and the number N of the ribs.

Then, the operator attaches to the syringe attachment 58 a syringe (with a nozzle) containing a red fluorescent paste (hereafter referred to as "R fluorescent paste") as a syringe 57 and a nozzle 56 (step S4). When the starting operations are performed on the keyboard 81 (step S5), the tip of the nozzle 56 is moved, based on the alignment mark M1, to the starting point for coating the R fluorescent paste and is maintained at a predetermined height (the clearance) (step S6).

The nozzle 56 then begins to eject the R fluorescent paste and, at the same time, moves in the direction shown by the arrow X, thereby starting the operation of applying the fluorescent paste (step S7). When the nozzle 56 moves by the length L of one rib, the nozzle 56 stops performing the ejecting and moving operations (operation of applying the fluorescent paste) (step S8 and step S9).

The nozzle 56 then moves for a pitch 3P in the direction shown by the arrow Y and begins the ejecting operation and the moving operation in the direction shown by the arrow X' (steps S10 to S12). After moving by length L, the nozzle 56 stops the ejecting and moving operations and moves for a pitch 3P in the direction shown by the arrow Y (steps S13 to S16). The nozzle 56 repeats the operations in the steps S7 to S16 and, when the number of coated grooves reaches 640 in the step S10 or S15, the work with the R fluorescent paste is completed.

The operator then replaces the syringe 57 and the nozzle 56 with those for green fluorescent paste (hereafter referred to as "G fluorescent paste") and repeats the operations in the steps S5 to S16 (steps S17, S18). After the coating of 640 grooves with the G fluorescent paste is finished, the syringe 57 and the nozzle 56 are replaced with those for a blue fluorescent paste (hereafter referred to as B fluorescent paste), and the coating of 640 grooves with the B fluorescent paste is conducted in the same manner as mentioned above (steps S19, S20).

Figure 17:
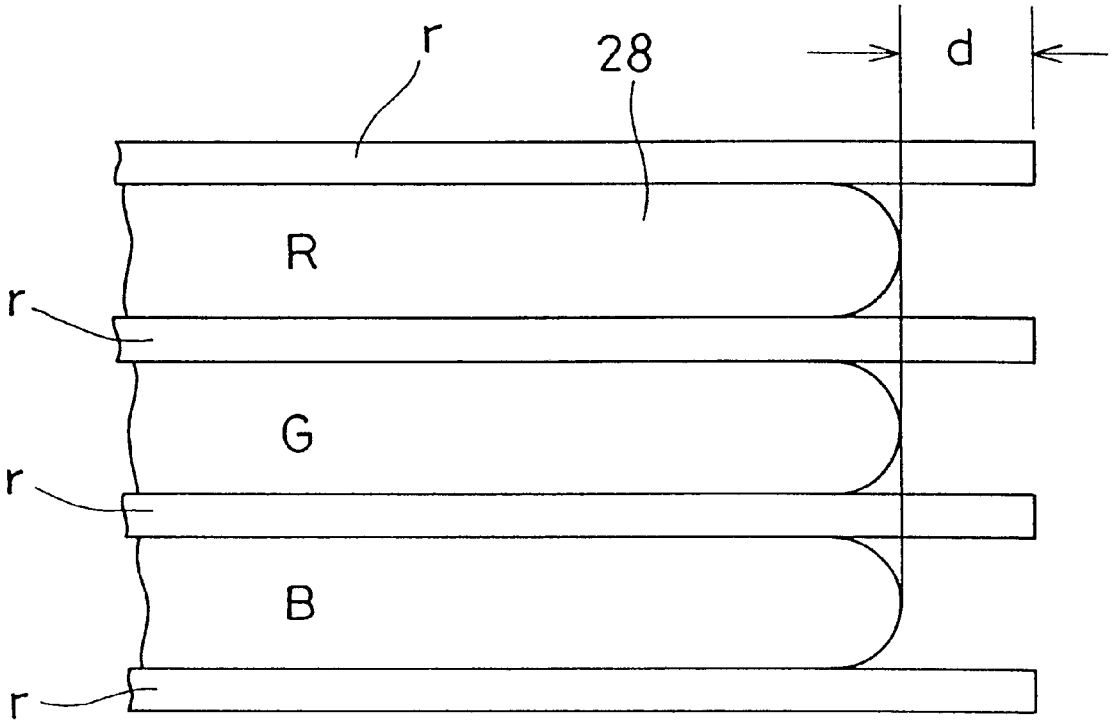
FIG. 17 is a top view showing a position relationship between the end of the rib and the location at which the application of the fluorescent paste is finished according to an embodiment of the present invention.

Here, the above coating operation is stopped so that a portion coated with the fluorescent paste 28 in each of the grooves is shorter than the groove by a predetermined distance , as shown in FIG. 17. This is for preventing the applied fluorescent paste from being extended around the end of the rib r into an adjacent groove. In this case, it has been experimentally shown that a distance d of more than 0.5 mm is sufficient.

The coating operation of the above embodiment is constructed in such a manner that, on finishing the application of the fluorescent paste into one groove, the nozzle 56 is moved in the direction shown by arrow Y by a predetermined pitch 3p so as to start the application of the fluorescent paste into the next groove. Alternatively, however, the coating operation may be performed by detecting, with the position sensors 59, 60, the front end and the rear end, respectively, of the rib forming the next groove to be coated every time the coating operation of one groove is finished, and by moving the nozzle 56 on the basis of the detected front and rear ends of the rib. This further improves the precision of applying the fluorescent paste into each groove. In this case, if the position sensors 59 and 60 cannot detect the front end or the rear end of the rib due to a certain cause (for example, a partial destruction of the rib end), the coating operation of applying the fluorescent paste into the next groove is performed on the basis of the predetermined rib pitch without discontinuing the coating operation.

When all the operations for forming R, G, and B fluorescent layers fitted onto the interior surface of the grooves between the ribs as shown in FIG. 1 are finished, the X-axis robot 54 returns to the home position (the position nearest to the upper perimeter of the platform 51 in the direction shown by the arrow Y' in FIG. 3). The operator then discharges the substrate 50 (step S21). The fluorescent paste on the discharged substrate 50 is dried in the subsequent step.

Here, in the above operation of applying the fluorescent paste, the tip of the nozzle 56 is maintained by the Z-axis robot 55 at a height such that the tip of the nozzle 56 is always away by the clearance C=100 $\mu$m from the calculated spline curved surface.

While the coating operation is performed in the directions shown by arrows X and X', the controller 80 watches the surface height (the thickness) of the fluorescent paste immediately after the application with the height sensor 62 and the height sensor 61, respectively. When the thickness of the applied fluorescent paste measured by the height sensors 62 and 61 deviates from a predetermined permissible range, the controller 80 immediately stops the coating operation (ejection and movement) of the nozzle 56. The controller 80 then lets an alarm indicating "poor application" and coordinates of the position of the stopped nozzle 56 to be displayed on the CRT 82. The controller 80 also stores the coordinates into the built-in RAM.

After the cause of the poor application (for example, the clogging of the nozzle) is removed, the operator replaces the substrate 50 on the platform 51 with a new one to start the coating operation again (steps S1 to S21).

This enables the "poor application" of the fluorescent paste to be detected much earlier than by the conventional method of inspecting the substrate after the three colors of R, G, and B have been applied and the drying step has been finished. Therefore, the efficiency and the yield in applying the fluorescent paste is improved. Also, since the RAM stores the position (coordinates) at which the "poor application" has occurred on the substrate, it is easy to perform the repairing or reapplying operation on the substrate.

In this Example, the substrate 50 was used having a plurality of ribs r independently formed on the surface as shown in FIG. 8, Alternatively, however, a substrate may be used in which the ends of the adjacent ribs are alternately connected with each other as shown in FIG. 9. According to such a rib shape, the connecting portion of the ends becomes an end position of coating for each fluorescent paste, so that the webbing (stringing) of the fluorescent paste at this portion can be prevented.

Further, it is preferable that the substrate to be used has such ribs r that two adjacent ribs leave each other at one end of the groove between the ribs and approach each other at the other end of the groove, as shown in FIG. 18, and the coating operation is started at the wider end of the groove and is finished at the narrower end of the groove. This is to ensure that the fluorescent paste 28 is easily introduced into the groove at the time of starting the coating operation and is prevented from being forced out of the groove at the time of finishing the coating operation.

Figure 10:
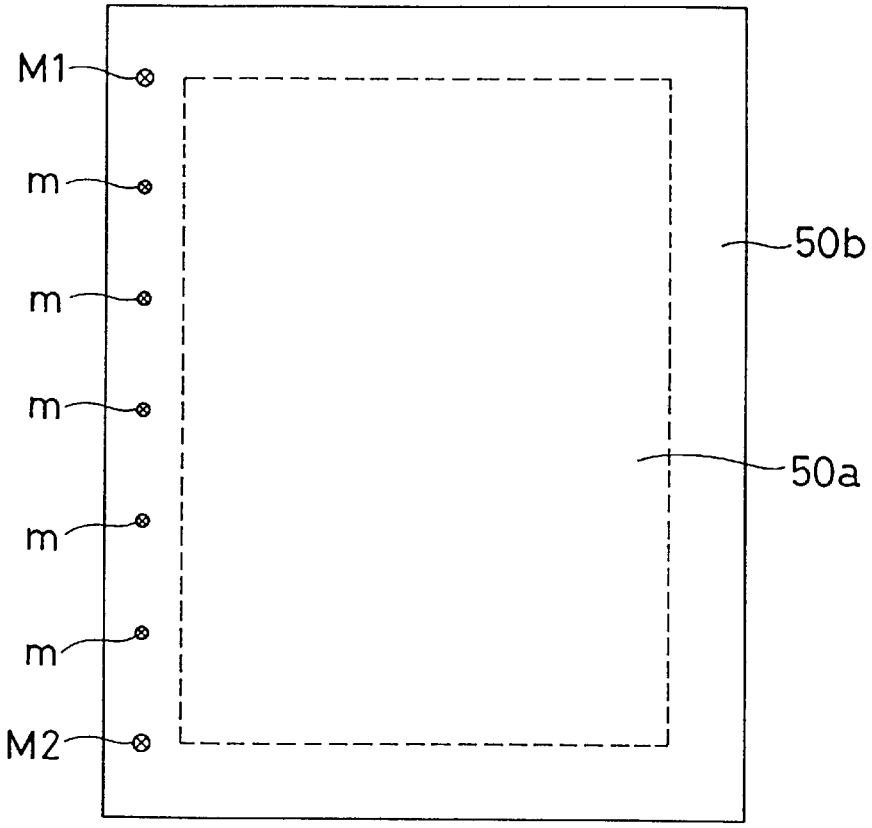
FIG. 10 is a top view showing a modified substrate applied to the present invention.

In this Example, the alignment marks M1 and M3 are detected for calculating the pitch P of the ribs r. Alternatively, however, auxiliary alignment marks m may be provided for every predetermined number of ribs, as shown in FIG. 10, and a pitch P of the ribs may be set in advance before the coating operations so that the pitch P may be corrected by the detection of the marks m with the position sensor 59 or 60 during the coating operations. The alignment marks M1, M2, M3, and m are formed simultaneously when the ribs r are formed on the substrate 50.

Figure 11:
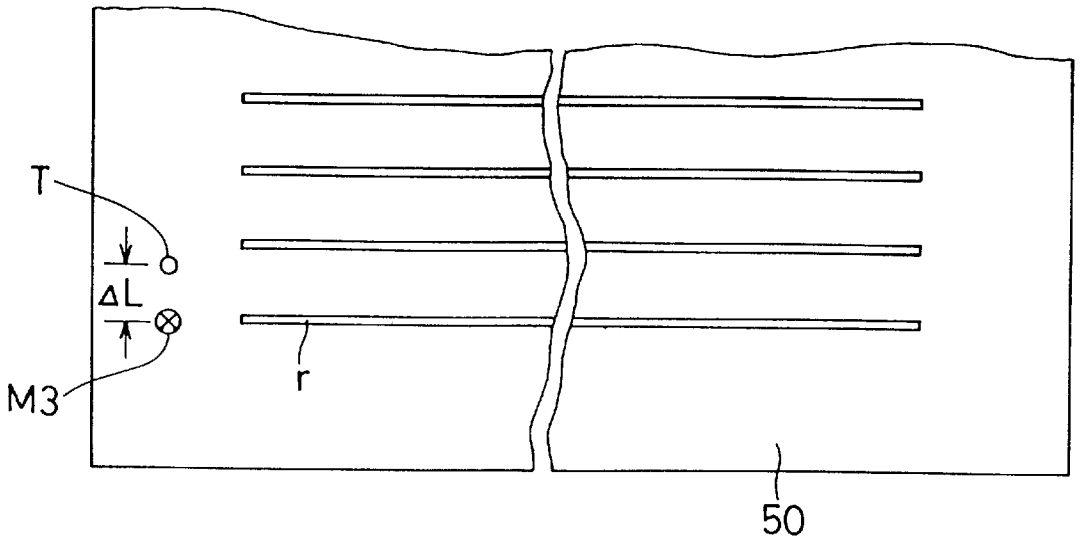
FIG. 11 is an enlarged view showing another method for correcting the rib pitch on the substrate of FIG. 7.

Alternatively, the pitch P may be set in advance before the coating operations and the position of the last rib to be coated may be calculated from the pitch P. The nozzle 56 is moved to the coordinate point corresponding to the rib as shown in FIG. 11 to draw a point T with the fluorescent paste. The coordinates of the point T and the coordinates of the alignment mark M3 are detected by the position sensor 60. The set pitch P is corrected by their distance difference $\Delta L$.

Figure 13:
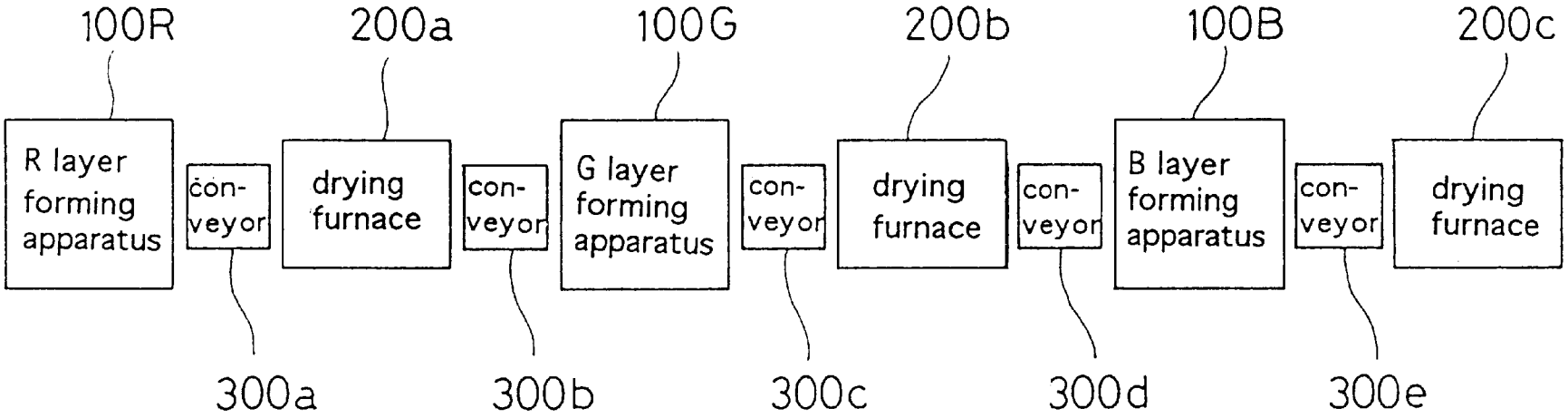
FIG. 13 is an explanatory view showing a construction of a system according to the present invention.

FIG. 13 is a view for explaining a construction of a system utilizing the apparatus shown in FIG. 2, in which an apparatus 100R for forming R fluorescent layers, a drying furnace 200*a*, an apparatus 100G for forming G fluorescent layers, a drying furnace 200*b*, an apparatus 100B for forming B fluorescent layers, and a drying furnace 200*c* are connected in series via conveyors 300*a* to 300*e*. All of the apparatus 100R for forming R fluorescent layers, the apparatus 100G for forming G fluorescent layers, and the apparatus for forming B fluorescent layers are similar to the fluorescent layer forming apparatus shown in FIG. 2. In this example, however, each of the syringes 57 contains one of an R fluorescent paste, a G fluorescent paste, and a B fluorescent paste.

In this construction, after 640 R fluorescent layers are formed on the surface of the substrate 50 (FIG. 7) by the R fluorescent layer forming apparatus 100R, the substrate 50 is transported to the drying furnace 200*a* by the conveyor 300*a* to be dried. The dried substrate 50 is transported to the G fluorescent layer forming apparatus 100G by the conveyor 300*b* for forming 640 G fluorescent layers on the surface of the substrate 50.

The substrate 50 is then transported to the drying furnace 200*b* by the conveyor 3006*c* to be dried. The dried substrate

50 is transported to the B fluorescent layer forming apparatus 100B by the conveyor 300*d* for forming 640 B fluorescent layers on the surface of the substrate 50.

The substrate 50 is further transported to the drying furnace 200*c* by the conveyor 300*e* to be dried. Subsequently, the substrate 50 is sintered with a sintering apparatus (not shown) to complete the R, G, and B fluorescent layers 28 fitted onto the interior surface of the grooves between the ribs 29 as shown in FIG. 1.

In the drying furnaces 200*a* to 200*c*, the fluorescent paste which fills the grooves on the substrate 50 is dried at a temperature of 100 to 200° C. for 10 to 30 minutes to form the fluorescent layer as mentioned above. The drying processes are conducted immediately after the fluorescent paste for each color is applied into the grooves because of the following reason. If the adjacent fluorescent paste previously applied is in a liquid state, the fluorescent paste subsequently applied extends over the rib to be mixed with the previous fluorescent paste by their surface tensions when being in contact, causing a mixed color. By subjecting the substrate to a drying step, the fluorescent paste filling the grooves between the ribs is fitted onto the interior surface of the grooves, thereby losing its surface tension. For the drying furnaces 200*a* to 200*c*, at least one of a hot plate method, a circulated hot air method, and a far infrared light method is employed.

Figure 14:
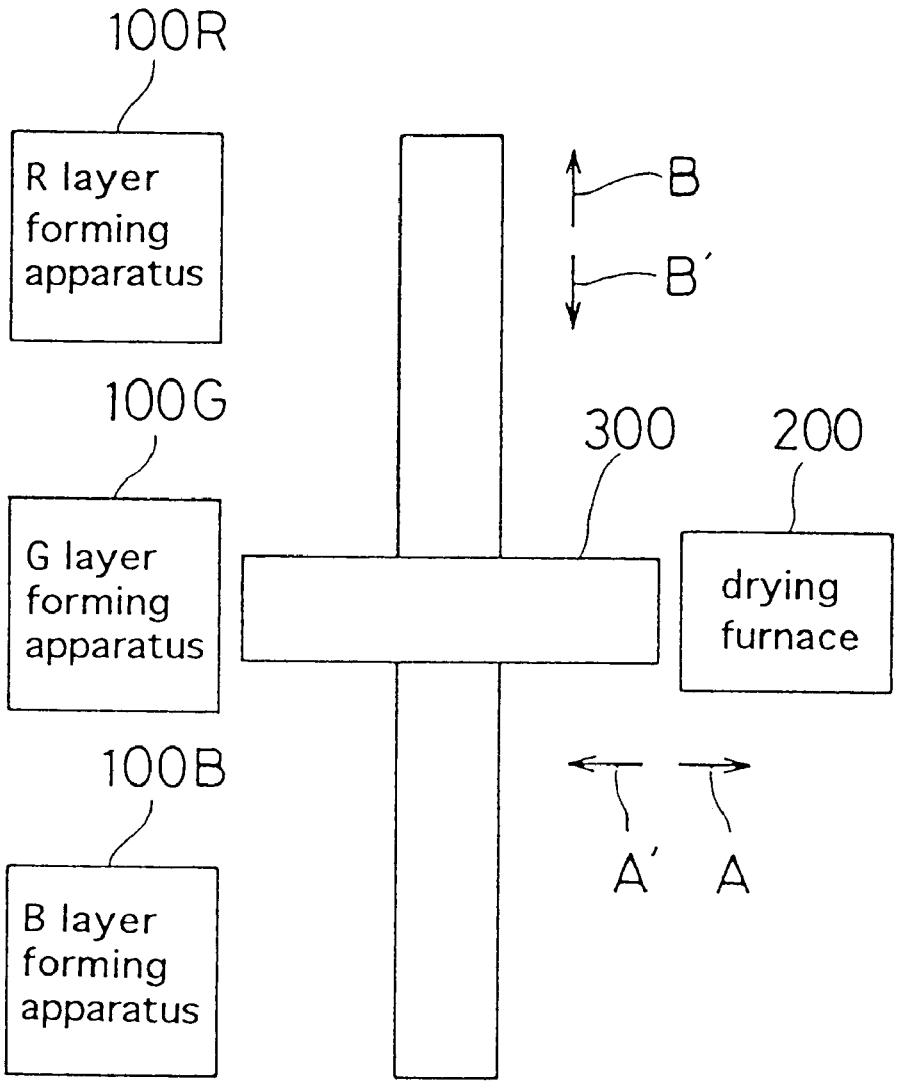
FIG. 14 is an explanatory view showing a construction of another system according to the present invention.

FIG. 14 is a view for explaining a construction of another system utilizing an apparatus as shown in FIG. 2. In this embodiment, one drying furnace 200 is provided instead of the three drying furnaces 200*a* to 200*c* as shown in FIG. 13. Instead of the conveyors 300*a* to 300*e*, a transporting robot 300 is provided for transporting the substrate 50 in a direction shown by arrows A–A' and in a direction shown by arrows B–B'.

In this construction, the substrate 50 is transported to the drying furnace 200 by the transporting robot 300 to be dried every time a fluorescent paste of each color is applied to the grooves in the same manner as in the system shown by FIG. 13.

Figure 15:
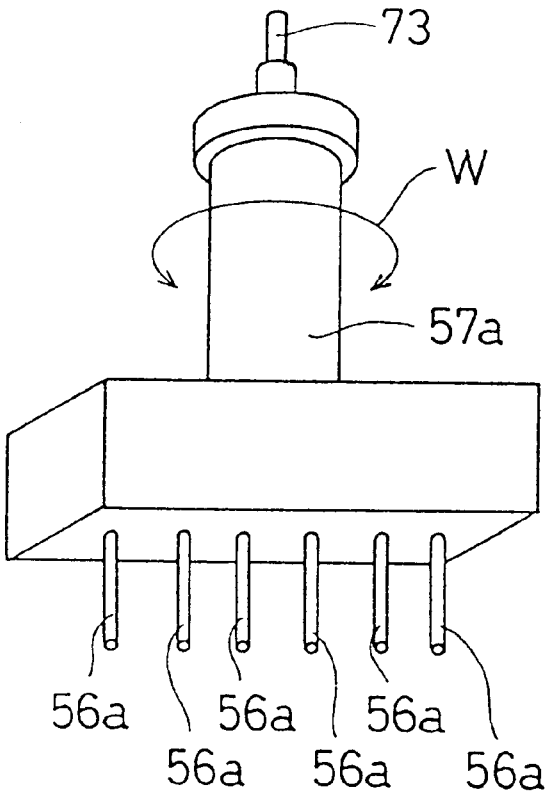
FIG. 15 is a perspective view showing a modified nozzle according to an embodiment of the present invention.
Figure 16:
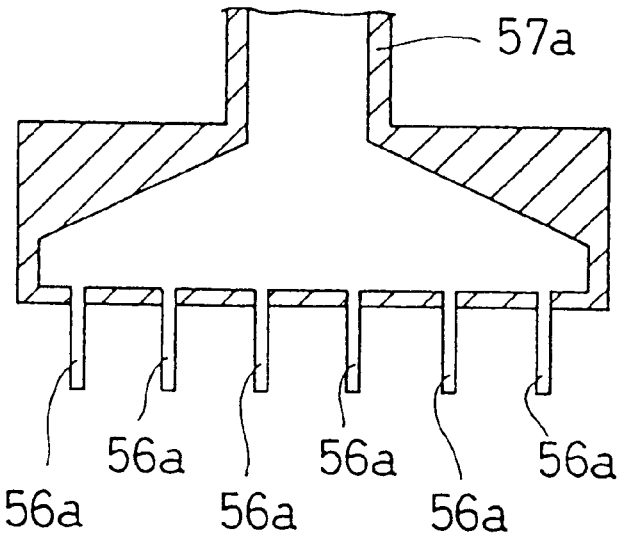
FIG. 16 is a cross-sectional view of the nozzle shown in FIG. 15.

FIG. 15 and FIG. 16 are a perspective view and a cross-sectional view showing a multi-nozzle as a modification of the syringe 57 and the nozzle 56 to be used in each of the above-described Examples.

In this multi-nozzle, six nozzles 56*a* are arranged in a line per each syringe 57*a* with a pitch six times longer than the rib pitch P.

When a fluorescent paste is applied, the fluorescent paste contained in the syringe 57*a* is ejected through the six nozzles 56*a* simultaneously. Therefore, six fluorescent layers of a color are formed at a time, thereby curtailing the time required for the coating operations to one sixth (⅙) as compared with each of the previously described Examples.

Now, the relationship between the rib pitch P, the nozzle pitch $P_N$, and the amount of movement of the nozzle in the Y direction will be explained when a multi-nozzle is used having n nozzles arranged in a line at a pitch of $P_N$ per each syringe (Here, it is assumed that the fluorescent pastes are provided in three colors of R, G, and B).

[A] The case where the fluorescent paste is applied while the nozzle is being moved in forward and backward directions.

The substrate shown in FIG. 8, FIG. 9, or FIG. 18 (especially the substrate having ribs in which the ends of the adjacent ribs are alternately open as shown in FIG. 9 or FIG. 18) may be used. The pitch $P_N$ of nozzle arrangement is set so that $P_N$ is 6P and the coating operation is carried out as follows.

(1) Applying the fluorescent paste simultaneously into n grooves at an application pitch of 6P while moving the nozzle in the X direction from the open guide (the opening of the first groove) of the end pattern of the rib, (2) Moving the nozzle in the Y direction by a distance of 3P so as to locate the nozzle at an open side of the end pattern of the rib (the opening of the second groove), (3) Applying the fluorescent paste newly into n grooves while moving the nozzle in the X' direction (Through the above steps, the fluorescent paste has been applied into 2n grooves at a pitch of 3P), (4) Moving the nozzle in the Y direction by a distance of 3P×(2n−1) so as to locate the nozzle at the opening of the third groove.

The above steps (1) to (4) are repeated.

[B] The case where the fluorescent paste is applied while the nozzle is being moved in one direction The substrate shown in FIG. 8 may be used. The pitch $P_N$ of nozzle arrangement is set so that $P_N$ is 3P and the coating operation is carried out as follows.

(1) Applying the fluorescent paste simultaneously into n grooves at an application pitch of 3P while moving the nozzle in a forward direction (in the X direction or in the X' direction), (2) Moving the nozzle in a backward direction without applying the fluorescent paste so as to return the nozzle to the point of starting the application of the fluorescent paste, (3) Moving the nozzle in the Y direction by a distance of 3P×n.

The above steps (1) to (3) are repeated.

In this manner, when the coating operation is carried out simultaneously with a plurality of nozzles 56*a*, it is difficult to apply the fluorescent paste uniformly and accurately into the groove corresponding to each nozzle if the end surface of the tip of the nozzle is perpendicular to the axis of the nozzle, even though the pitch of the nozzle is let to coincide with the rib pitch with high precision. This is because the fluorescent paste cannot be easily ejected immediately under the tip of the nozzle due to the viscosity and the surface tension of the fluorescent paste.

Figure 19:
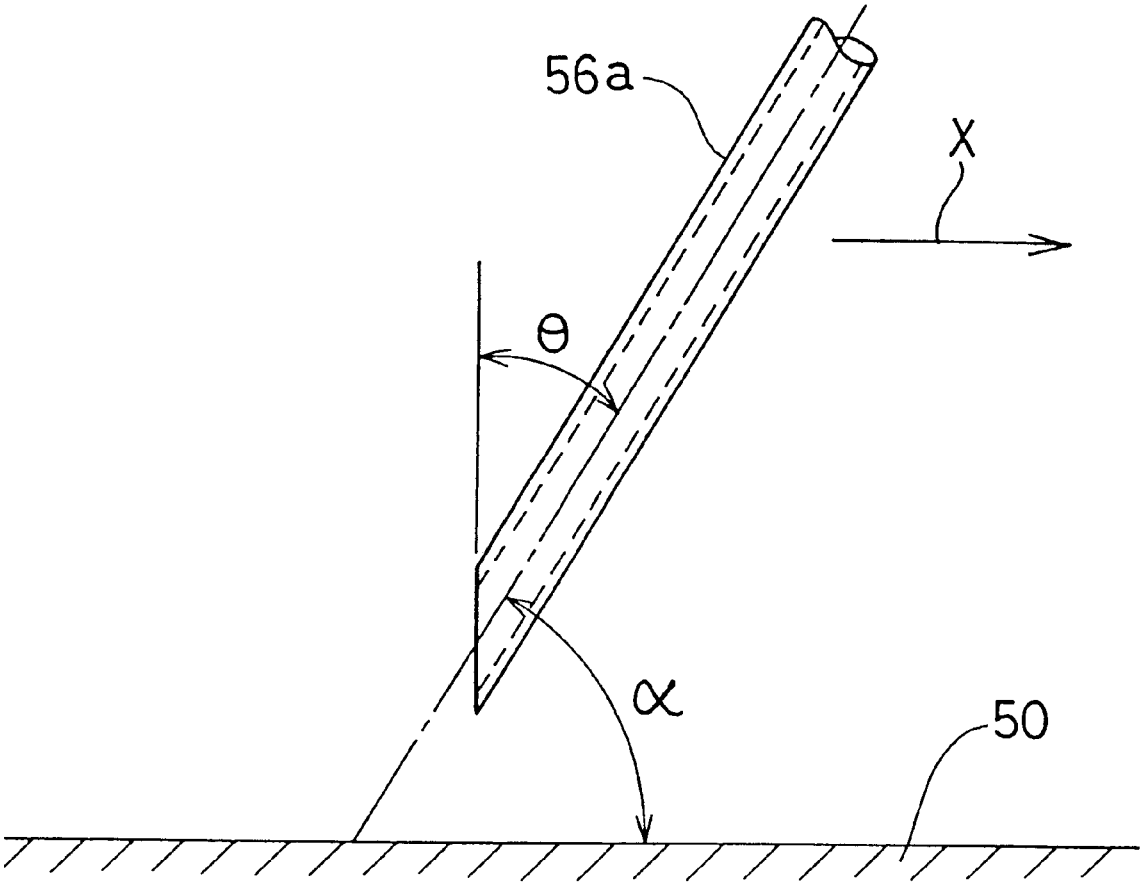
FIG. 19 is a side view showing a modified tip of the nozzle according to the present invention.

Therefore, when a plurality of nozzles are to be used, it is preferable that each of the nozzles has an end surface formed at an acute angle of θ relative to the axis of the nozzle, as shown in FIG. 19. Also, it is preferable that the nozzle is held at an acute angle of θ relative to the substrate 50 in the direction of applying the fluorescent paste so that the opening of the tip of the nozzle is oriented in a direction opposite to the direction of applying the fluorescent paste. In such a case, the angle θ is set to be within the range of 30° to 60°, and the angle CL is set to be within the range of 45° to 70°. This makes it possible to eject the fluorescent paste from each of the nozzles with certainty in the direction opposite to the direction of applying the fluorescent paste, thereby fixing the direction of ejection. Thus, each of the nozzles can apply the fluorescent paste with accuracy into each of the intended grooves.

The syringe 57*a* is attached to the syringe attachment 58 (FIG. 4) so that each of the nozzles 56*a* is arranged perpendicular to the ribs. However, when a mechanism is provided for rotating the syringe 57*a* in a direction shown by an arrow W in FIG. 15, the rotation of the syringe 57*a* makes it possible to adjust the coating pitch of the nozzles 56*a*.

Figure 20:
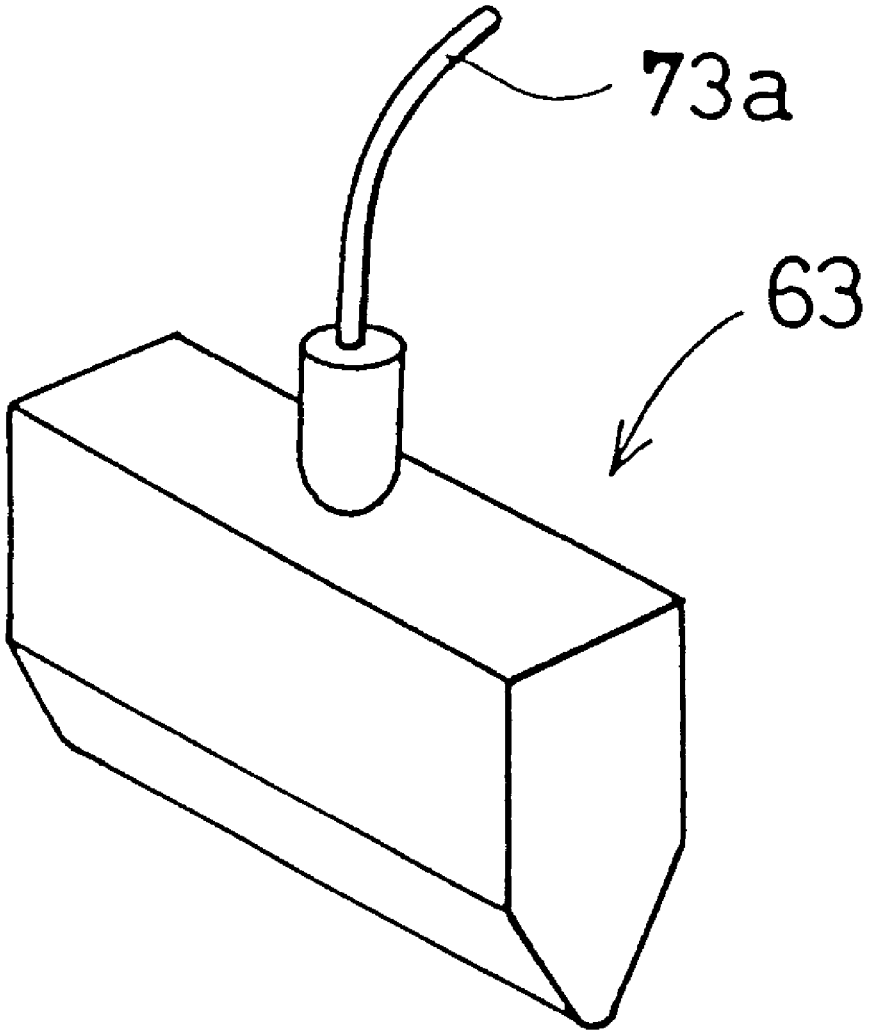
FIG. 20 is a perspective view showing an application head which is another modified nozzle according to the present invention.

Further, according to the present invention, it is possible to conduct fluorescent paste application similar to the one for the above-described multi-nozzle by using a head 63 shown in FIG. 20 obtained by improving the applicator head of a coating apparatus called a slot-die coater or a die-coater for applying a curtain-like paste.

Figure 21:
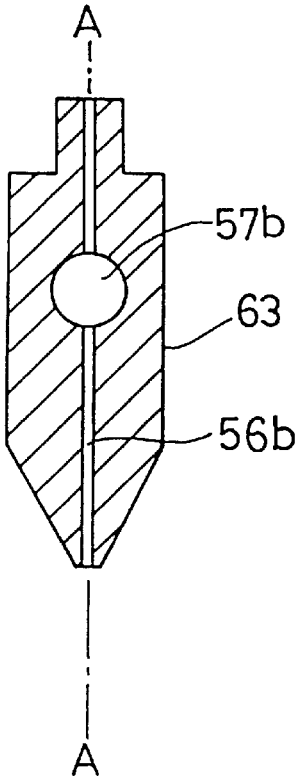
FIG. 21 is a longitudinal cross-sectional view of the application head shown in FIG. 20.
Figure 22:
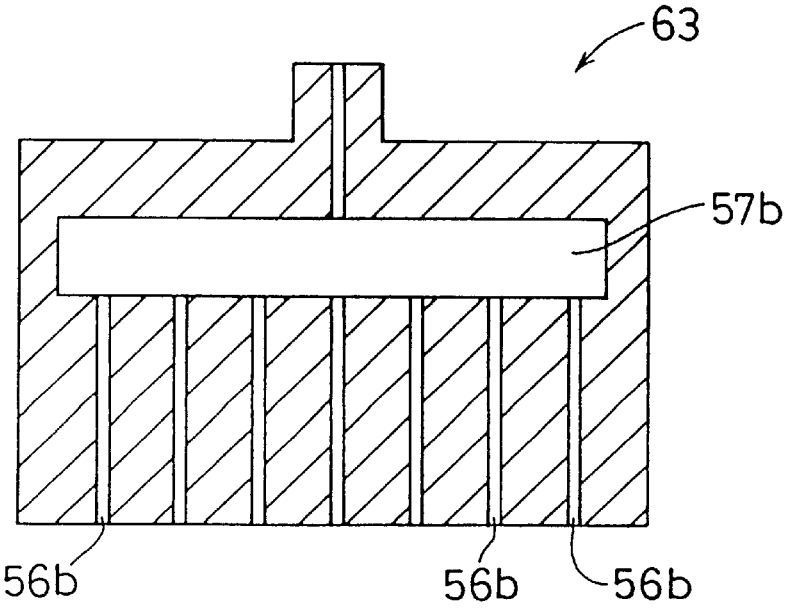
FIG. 22 is a cross-sectional view along the line A—A of FIG. 21.

The longitudinal cross section of the head 63 is shown in FIG. 21, and the cross section of FIG. 21 along the A—A line is shown in FIG. 22. As shown in these Figures, the head 63 includes therein a reservoir tank 57*b* for temporarily storing the fluorescent paste and a plurality of gaps (channels) 56*b* for ejecting the fluorescent paste, the gap corresponding to the nozzle 56*a* in FIG. 16. Through these channels 56*b*, the fluorescent paste is ejected in a manner like the teeth of a comb. For forming the above-described fluorescent layers of the three colors, the heads 63 corresponding to each of the three colors are arranged as mentioned above for completing the entire coating operations.

According to the present invention, a fluorescent paste can be ejected from a nozzle moving over a substrate so as to be applied into the grooves between the ribs without the use of a conventional screen mask and by simply setting the substrate design numerically. Therefore, it is possible to form fluorescent layers accurately on a substrate of any size and to easily comply with a change in substrate design.

What we claim is:

1. An apparatus for forming fluorescent layers in a plasma display panel by applying a fluorescent paste into grooves formed between a plurality of ribs disposed in parallel on a surface of a substrate, the apparatus comprising:

a platform for mounting the substrate thereon;

a dispenser for ejecting the fluorescent paste, comprising a plurality of nozzles spaced corresponding to a predetermined number of grooves for ejecting the fluorescent paste, whereby the fluorescent paste is applied simultaneously into a plurality of grooves;

a transporter for moving the nozzles relative to the platform; and a controller for controlling the transporter and the dispenser so that the fluorescent paste is consecutively applied into the selected grooves.

2. An apparatus for forming fluorescent layers according to claim 1, wherein the controller further performs a function of controlling the transporter and the dispenser on the basis of a predetermined rib pitch.

3. An apparatus for forming fluorescent layers in a plasma display panel by applying a fluorescent paste into grooves formed between a plurality of ribs disposed in parallel on a surface of a substrate, the apparatus comprising:

a platform for mounting the substrate thereon;

a dispenser having at least one nozzle for ejecting the fluorescent paste;

a transporter for moving the nozzle relative to the platform; and a controller for controlling the transporter and the dispenser so that the fluorescent paste is consecutively applied into selected grooves, and so that a step of applying the fluorescent paste is started while maintaining a distance between the nozzle and the substrate to be a first distance and the step of applying the fluorescent paste is subsequently continued while maintaining the distance between the nozzle and the substrate to be a second distance larger than the first distance.

4. An apparatus for forming fluorescent layers according to claim 3, wherein the substrate to be used comprises an effective display region at a central portion thereof and an ineffective display region around the effective display region, and the controller controls the transporter and the dispenser so that the fluorescent paste is applied while maintaining the distance between the nozzle and the substrate to be the first distance over the ineffective display region and to be the second distance over the effective display region.

5. An apparatus for forming fluorescent layers in a plasma display panel by applying a fluorescent paste into grooves formed between a plurality of ribs disposed in parallel on a surface of a substrate having an alignment mark formed on the surface thereof, the apparatus comprising:

a platform for mounting the substrate thereon;

a dispenser having at least one nozzle for ejecting the fluorescent paste;

a transporter for moving the nozzle relative to the platform;

a controller for controlling the transporter and the dispenser so that the fluorescent paste is consecutively applied into selected grooves; and a position sensor for detecting a position of at least one of the alignment mark and a rib tip on the substrate, whereby the controller further performs a function of controlling the transporter and the dispenser on the basis of the position detected by the position sensor.

6. An apparatus for forming fluorescent layers according to claim 5, wherein the controller further performs a function of predetermining a pitch of applying a fluorescent paste and a function of correcting the predetermined pitch on the basis of at least one of the alignment mark and the rib end detected by the position sensor.

7. An apparatus for forming fluorescent layers in a plasma display panel by applying a fluorescent paste into grooves formed between a plurality of ribs disposed in parallel on a surface of a substrate, the apparatus comprising:

a platform for mounting the substrate thereon;

a dispenser having at least one nozzle for ejecting the fluorescent paste;

a transporter for moving the nozzle relative to the platform;

a controller for controlling the transporter and the dispenser so that the fluorescent paste is consecutively applied into selected grooves; and a height sensor for measuring a height of an arbitrary point on the substrate from the platform, the controller adjusting the distance between the nozzle and the substrate at the time of applying the fluorescent paste on the basis of the height measured by the height sensor.

8. An apparatus for forming fluorescent layers according to claim 7, wherein the controller further performs functions of measuring the height of arbitrary three points on the surface of the mounted substrate or on the ribs in advance with the height sensor, of establishing a virtual curved surface connecting the measured points, and of controlling the transporter and the dispenser so that the tip of the nozzle is moved parallel to the virtual curved surface to apply the fluorescent paste into the grooves.

9. An apparatus for forming fluorescent layers in a plasma display panel by applying a fluorescent paste into grooves formed between a plurality of ribs disposed in parallel on a surface of a substrate, the apparatus comprising:

a platform for mounting the substrate thereon;

a dispenser having at least one nozzle for ejecting the fluorescent paste;

a transporter for moving the nozzle relative to the platform;

a thickness sensor for measuring the thickness of the fluorescent paste applied into the groove; and a controller for controlling the transporter and the dispenser so that the fluorescent paste is consecutively applied into selected grooves, and for stopping the application of the fluorescent paste when the thickness measured by the thickness sensor deviates from a predetermined permissible range.

10. An apparatus for forming fluorescent layers in a plasma display panel by applying a fluorescent paste into grooves formed between a plurality of ribs disposed in parallel at a predetermined rib pitch on a surface of a substrate, the apparatus comprising:

a platform for mounting the substrate thereon;

a dispenser having at least one nozzle for ejecting the fluorescent paste;

a transporter for moving the nozzle relative to the platform;

a controller for controlling the transporter and the dispenser so that the fluorescent paste is consecutively applied into selected grooves; and a position sensor for detecting an end of the rib, wherein the controller further performs a function of controlling the transporter and the dispenser on the basis of the detected end when the end is clearly detected by the position sensor and on the basis of the predetermined rib pitch when the end cannot be clearly detected.

11. An apparatus for forming fluorescent layers in a plasma display panel by applying a fluorescent paste into grooves formed between a plurality of ribs disposed in parallel on a surface of a substrate, the apparatus comprising:

a platform for mounting the substrate thereon;

a dispenser having at least one nozzle for ejecting the fluorescent paste;

a transporter for moving the nozzle relative to the platform; and a controller for controlling the transporter and the dispenser so that the fluorescent paste is consecutively applied into and coated on selected grooves and so that the length of a coated portion of the groove is shorter than the length of the entire groove by a predetermined distance.

12. An apparatus for forming fluorescent layers in a plasma display panel by applying a fluorescent paste into grooves formed between a plurality of ribs disposed in parallel on a surface of a substrate, the apparatus comprising:

a platform for mounting the substrate thereon;

a dispenser having at least one nozzle for ejecting the fluorescent paste, the nozzle having an end surface formed obliquely relative to the axis of the nozzle;

a transporter for moving the nozzle relative to the platform; and a controller for controlling the transporter and the dispenser so that the fluorescent paste is consecutively applied into selected grooves.

13. An apparatus for forming fluorescent layers according to claim 12, wherein the nozzle is held at an acute angle with the substrate in the direction of applying the fluorescent paste.

14. A method for manufacturing one of a pair of substrate assemblies constituting a color plasma display panel, the manufactured substrate assembly having fluorescent layers of three different colors, the method comprising:

a rib formation step of forming a plurality of ribs having a straight central portion and opposite ends bent in such a manner that the opposite ends are bent in opposite directions, and arranging the ribs on a substrate for the substrate assembly so that two adjacent ribs leave each other at one end of the groove therebetween and approach each other at the other end of the groove and are parallel to each other at the central portion thereof as seen from above the substrate; and a coating step of applying a fluorescent paste of one color into a groove formed between two adjacent ribs by moving a nozzle for ejecting the fluorescent paste along the groove, the movement of the nozzle being started from an end of the groove where the two adjacent ribs leave each other, wherein the fluorescent paste of the one color is applied into every third groove formed between ribs by consecutive reciprocating movement of the nozzle along the grooves in the coating step.

15. A system, comprising:

a plurality of apparatuses for respectively forming fluorescent layers having different respective colors in grooves on a substrate, each apparatus comprising:

a platform for mounting the substrate thereon;

a dispenser having a nozzle to eject fluorescent paste;

a transporter for moving the nozzle relative to the platform; and a controller for controlling the transporter and the dispenser so that the fluorescent paste is consecutively applied into selected grooves.

16. A system according to claim 15, wherein the apparatuses are arranged in a series, the system further comprising:

a plurality of dryers each provided between the fluorescent layer forming apparatus, each of the dryers serving to dry the fluorescent paste applied into the grooves between the ribs on the substrate; and a plurality of substrate transporters provided for transporting the substrate between each of fluorescent layer forming apparatus and each of the dryers.

17. A system for forming fluorescent layers according to claim 16, wherein:

each of the fluorescent layer forming apparatus consecutively applies each fluorescent paste into the grooves on the substrate, the grooves corresponding to the color of the fluorescent paste;

each of the dryers dries the fluorescent paste in the grooves between the ribs on the substrate to such a degree that at least no surface tension is generated; and each of the substrate transporters transports the substrate having the fluorescent paste thereon from one of the fluorescent layer forming apparatus to the next fluorescent layer forming apparatus adjacent thereto via one of the dryers, so that the filling and the drying of the fluorescent paste of each color are alternately conducted, the drying process serving to allow the fluorescent layers to be deposited onto interior surfaces of the grooves between the ribs.

18. A system according to claim 15, further comprising:

a dryer for drying the substrate; and a substrate transporter for transporting the substrate between each of the fluorescent layer forming apparatus and the dryer.

19. A system for forming fluorescent layers according to claim 18, wherein:

each of the fluorescent layer forming apparatus consecutively applies a fluorescent paste into grooves on the substrate, the grooves corresponding to the color of the fluorescent paste;

the dryer dries the fluorescent paste in the grooves between the ribs on the substrate to such a degree that at least no surface tension is generated; and the substrate transporter transports the substrate having the fluorescent paste thereon from one of the fluorescent layer forming apparatus to another of the fluorescent layer forming apparatus via the dryer, so that the filling and the drying of the fluorescent paste of each color are alternately conducted, the drying process serving to allow the fluorescent layers to be deposited onto interior surfaces of the grooves between the ribs.

20. A method for consecutively applying a plurality of fluorescent pastes having different colors into grooves formed between a plurality of ribs disposed in parallel on a substrate surface, the different colors including at least first and second colors, the method comprising the steps of:

preparing a plurality of fluorescent layer forming apparatus each ejecting a fluorescent paste of each color;

applying the fluorescent paste of the first color into first grooves on the substrate surface with one of the fluorescent layer forming apparatus, the first grooves corresponding to the fluorescent paste of the first color;

drying the fluorescent paste of the first color applied into the first grooves to such a degree that at least no surface tension is generated;

applying the fluorescent paste of the second color subsequently with another of the fluorescent layer forming apparatus into second grooves adjacent the first grooves on the substrate, the second grooves corresponding to the fluorescent paste of the second color; and drying the fluorescent paste of the second color applied into the second grooves to such a degree that at least no surface tension is generated, and alternately repeating the steps of applying and drying the fluorescent paste of each color.

21. A method for applying fluorescent pastes according to claim 20, wherein each fluorescent layer forming apparatus comprises a dispenser having a plurality of nozzles, the nozzles being spaced at a rib pitch which is an integer multiple of the number of the colors, whereby the fluorescent paste of each color is simultaneously ejected to fill a plurality of different grooves on the substrate.

22. A method for applying fluorescent pastes according to claim 20, wherein the fluorescent paste in the grooves between the adjacent ribs is fitly deposited onto interior surfaces of the grooves to lose its surface tension in the drying step.

23. A method for applying fluorescent pastes according to claim 20, wherein each fluorescent layer forming apparatus comprises a dispenser for ejecting a fluorescent paste.

24. A method for applying fluorescent pastes of three different colors into grooves between a plurality of ribs spaced in parallel at a pitch P on a substrate, wherein a fluorescent paste dispenser comprises n nozzles spaced at a pitch of 6P, the method comprising repetition of the steps of:

(1) applying a fluorescent paste simultaneously at the pitch of 6P into n grooves with the n nozzles while moving the dispenser in a forward direction;

(2) moving the dispenser by a distance of 3P in a direction perpendicular to the ribs;

(3) applying the fluorescent paste into n grooves while moving the dispenser in a backward direction; and (4) moving the dispenser by a distance of $3P\times(2n-1)$ in the direction perpendicular to the ribs.

25. A method for applying fluorescent pastes according to claim 24, wherein the substrate to be used has such ribs that ends of an adjacent pair of ribs are alternately connected so that the ribs meander.

26. A method for applying fluorescent pastes according to claim 24, wherein the substrate to be used has such ribs that two adjacent ribs leave each other at one end of the groove therebetween and approach each other at the other end of the groove.

* * * * *